US008789474B2

(12) United States Patent
Kim et al.

(10) Patent No.: US 8,789,474 B2
(45) Date of Patent: Jul. 29, 2014

(54) DESK FOR CORRECT POSTURE AND SYSTEM FURNITURE INCLUDING THE SAME

(76) Inventors: Sung Yoon Kim, Goyang-si (KR); Chong Jae Kim, Goyang-si (KR)

( * ) Notice: Subject to any disclaimer, the term of this patent is extended or adjusted under 35 U.S.C. 154(b) by 58 days.

(21) Appl. No.: 13/639,158

(22) PCT Filed: Apr. 7, 2011

(86) PCT No.: PCT/KR2011/002455

§ 371 (c)(1),
(2), (4) Date: Oct. 3, 2012

(87) PCT Pub. No.: WO2011/126325

PCT Pub. Date: Oct. 13, 2011

(65) Prior Publication Data

US 2013/0019547 A1 Jan. 24, 2013

(30) Foreign Application Priority Data

Apr. 7, 2010 (KR) ..... 10-2010-0031622
Apr. 6, 2011 (KR) ..... 10-2011-0031864

(51) Int. Cl.
*A47F 5/12* (2006.01)

(52) U.S. Cl.
USPC ..... 108/10; 100/3; 100/6; 100/50.01; 100/92; 100/138

(58) Field of Classification Search
CPC ..... A47F 5/12; A47B 21/0314; A47B 41/02; A47B 57/04
USPC ..... 312/196, 223.3; 108/1, 3, 5–10, 50.01, 108/92, 138, 145, 147.11, 147.22
See application file for complete search history.

(56) References Cited

U.S. PATENT DOCUMENTS 2,223,405 A * 12/1940 Cain ..... 108/3
2,846,808 A * 8/1958 Hubert ..... 108/9

(Continued)

FOREIGN PATENT DOCUMENTS

CH 194157 11/1937
DE 29804307 6/1998

(Continued)

OTHER PUBLICATIONS

International Search Report—PCT/KR2011/002455 dated Dec. 15, 2011.

(Continued)

*Primary Examiner* — Hanh V Tran
(74) *Attorney, Agent, or Firm* — Cantor Colburn LLP

(57) ABSTRACT

A desk according to one embodiment of the present invention includes an upper panel, a support leg, a support member, a movable panel and a vertical panel. The upper panel is coupled to an upper end of the support leg. The support member extends from the upper panel. The movable panel has an upper end movable along the support member and a lower end movably placed on the upper panel. The movable panel is movable between a first position inclined with respect to the upper panel and a second position vertical to the upper panel and between the first position and a third position parallel to the upper panel. The vertical panel is rotatably joined to the support member. A lower end of the vertical panel is movably placed on the movable panel. The vertical panel moves along with the movement of the movable panel.

20 Claims, 33 Drawing Sheets

(56) References Cited

U.S. PATENT DOCUMENTS

| | | | | |
|---|---|---|---|---|
| 3,872,800 | A * | 3/1975 | Wallis et al. | 108/6 |
| 4,717,112 | A | 1/1988 | Pirkle | |
| 4,921,302 | A * | 5/1990 | Godwin | 297/170 |
| 5,413,051 | A * | 5/1995 | Tseng | 108/6 |
| 5,452,876 | A * | 9/1995 | Hatcher | 248/441.1 |
| 5,636,394 | A * | 6/1997 | Bartley | 5/611 |
| 5,671,091 | A * | 9/1997 | Monroe et al. | 359/635 |
| 5,730,068 | A * | 3/1998 | Rioux, Jr. | 108/99 |
| 5,735,222 | A * | 4/1998 | Webb | 108/144.11 |
| 6,302,032 | B1 * | 10/2001 | Ranspach | 108/12 |
| 6,530,631 | B2 * | 3/2003 | Brown | 312/280 |
| 6,712,008 | B1 * | 3/2004 | Habenicht et al. | 108/96 |
| 7,721,658 | B2 * | 5/2010 | Seeley et al. | 108/50.01 |
| 7,823,973 | B2 * | 11/2010 | Dragusin | 297/217.3 |
| 7,886,671 | B2 * | 2/2011 | Roberge et al. | 108/50.01 |
| 7,938,069 | B2 * | 5/2011 | Hu | 108/6 |
| 8,424,464 | B2 * | 4/2013 | Korpi | 108/9 |
| 8,662,605 | B2 * | 3/2014 | McRorie et al. | 312/276 |
| 2006/0027146 | A1 * | 2/2006 | Lee | 108/6 |
| 2006/0065163 | A1 * | 3/2006 | Chi et al. | 108/7 |
| 2010/0307382 | A1 * | 12/2010 | Mammana et al. | 108/5 |

FOREIGN PATENT DOCUMENTS

| | | |
|---|---|---|
| JP | 08054962 | 2/1996 |
| JP | 2007037927 | 2/2007 |
| JP | 3144050 | 7/2008 |
| KR | 200182180 | 3/2000 |
| KR | 1020030042808 | 6/2003 |
| KR | 200357588 | 7/2004 |
| KR | 1020060109275 | 10/2006 |
| KR | 1020090045777 | 5/2009 |
| WO | 03043461 | 5/2003 |

OTHER PUBLICATIONS

European Search Report—European Application No. 11766176.9 issued on Jul. 12, 2013 citing WO 03/043461, CH 194 157, KR 2006 0109275, DE 298 04 307 and US 4 717 112.

* cited by examiner

DESK FOR CORRECT POSTURE AND SYSTEM FURNITURE INCLUDING THE SAME

CROSS-REFERENCE TO RELATED APPLICATIONS

This application is a national stage filling under 35 U.S.C §371 of International Patent Application No. PCT/KR2011/002455, filed Apr. 7, 2011, the entire contents of which are incorporated by reference herein; claims the benefit of Korean Patent Application No. 2010-0031622, filed Apr. 7, 2010, the entire contents of which are incorporated by reference herein; and also claims the benefit of Korean Patent Application No. 2011-0031864, filed Apr. 6, 2011, the entire contents of which are incorporated by reference herein.

TECHNICAL FIELD

The present invention relates to a desk for implementing correct posture and a system furniture including the same.

BACKGROUND

Activities enhancing human intellectual creativity increases human evolution. In this respect, desks played a fundamental part in promoting such activities. FIG. 1 is a side view showing an exemplary use of a conventional desk. As shown in FIG. 1, a convention desk 10 includes a horizontal panel 11 and support legs 12. Since the horizontal panel 11 is fixed to the support legs 12, the user's upper body must bow down to read books or papers placed on the horizontal panel 11. In such a case, this causes incorrect posture that leads to pain in the neck, shoulder, waist, etc. In particular, a user who has to sit for a long time would have to often endure such pains. For example, if the head is bent down for a long time, then the neck bone turns into an "I" shape to support the bent neck bone and the muscles surrounding the neck bone become tense. This obviously causes pain in the neck and shoulder and further leads to cervical disk problem.

To resolve the aforementioned disadvantages of the conventional desk, various types of desks have been developed. For example, FIG. 2 shows an exemplary use of a study desk disclosed in Korean Utility Model Registration No. 20-0182180. As shown in FIG. 2, the study desk 20 has a horizontal panel 21 and support legs 22. The horizontal panel 21 is configured to rotate around a rotation shaft 21*a* with respect to the support legs 22, thus adjusting the slant angle of the horizontal panel 21. However, the mere adjustment of the slant angle of the horizontal panel 21 only merely eases the bent degree of the user's upper body. Accordingly, the upper body of the user must still bow down to use the desk.

SUMMARY

The present invention has been made to solve the aforementioned problems. It is an object of the present invention to provide various types of desks for implementing correct posture.

It is a further object of the present invention to provide various types of system furniture including such desks.

A desk according to one embodiment of the present invention includes an upper panel, a support leg, a support member, a movable panel and a vertical panel. The upper panel is coupled to an upper end of the support leg. The support member extends from the upper panel. The movable panel has an upper end movable along the support member and a lower end movably placed on the upper panel. The movable panel is movable between a first position inclined with respect to the upper panel and a second position vertical to the upper panel and between the first position and a third position parallel to the upper panel. The vertical panel is rotatably joined to the support member. The vertical panel is movably placed on the movable panel at a lower end thereof. The vertical panel moves along with the movement of the movable panel.

A desk according to one embodiment of the present invention includes a support leg, an upper panel, a first slant panel and a second slant panel. The upper panel is coupled to an upper end of the support leg. A lower end of the first slant panel is rotatably coupled to a topside of the upper panel. A lower end of the second slant panel is rotatably coupled to an upper end of the first slant panel.

A desk according to one embodiment of the present invention includes an upper panel, partition panels, a support member, a movable panel and a vertical panel. The partition panels are vertically coupled to both ends and a rear end of the upper panel. The support member extends from the upper panel. The movable panel has an upper end movable along the support member and a lower end movably placed on the upper panel. The movable panel is movable between a first position inclined with respect to the upper panel and a second position vertical to the upper panel and between the first position and a third position parallel to the upper panel. The vertical panel is rotatably joined to the support member. The vertical panel is movably placed on the movable panel at a lower end thereof. The vertical panel moves along with the movement of the movable panel.

A desk according to one embodiment of the present invention includes a horizontal panel, a first slant panel and a second slant panel. The first slant panel has a lower end rotatably coupled to the horizontal panel. The second slant panel has a lower end rotatably coupled to an upper end of the first slant panel.

A system furniture according to one embodiment of the present invention includes closets, a desk and a second drive means. A pair of closets are placed spaced apart from each other. The desk is disposed between the closets. The desk includes a support leg, an upper panel, a support member, a movable panel and a vertical panel. The second drive means vertically lifts and lowers the desk.

A multimedia room according to one embodiment of the present invention includes the system furniture and a stereophonic sound system coupled to one side of the desk.

First, the desk according to the present invention includes the upper panel, the movable panel and the vertical panel. Thus, a user can read papers or books placed on the movable panel while maintaining a correct posture without bowing his/her upper body. Accordingly, pains in the neck or shoulder caused by the bending of the upper body can be avoided. Further, the user slightly bows his/her head and can look at papers or books placed on the movable panel. That is, even when using the movable panel and the vertical panel together, the user can minimize the shift of his/her eyesight and the work efficiency can be enhanced.

Second, the desk according to the present invention includes various types of support members. Thus, when the user does not use the movable panel and the vertical panel, the movable panel and the vertical panel may be vertically juxtaposed one above the other or horizontally juxtaposed one behind the other. In this state, the user can use the upper panel. Further, the slant angle of the movable panel and the height of the vertical panel may be adjusted depending on the body type or posture of the user.

Third, the desk according to the present invention includes a first auxiliary panel, a second auxiliary panel, an expansion panel and a third auxiliary panel, thereby providing a large work space to the user. Further, the upper panel according to the present invention includes a first upper panel and a second upper panel. Thus, the user can use the second upper panel while variously adjusting the position and slant angle of the second upper panel.

Fourth, the closet of the system furniture according to the present invention includes a fixed closet and a movable closet. Thus, an interior space of the fixed closet may be utilized for other purposes. Further, an image display device, a desk and a bed are configured to be vertically lifted and lowered, thus enhancing space utilization. Moreover, the system furniture according to the present invention is configured as a single module. Thus, it may be applied to a mobile house, a studio apartment or the like. Also, the system furniture according to the present invention can include a stereophonic sound system and an image camera, thus forming a multimedia room.

DETAILED DESCRIPTION

Hereinafter, a desk and a system furniture including the desk according to various embodiments of the present invention will be described in detail with reference to the accompanying drawings.

Figure 1:
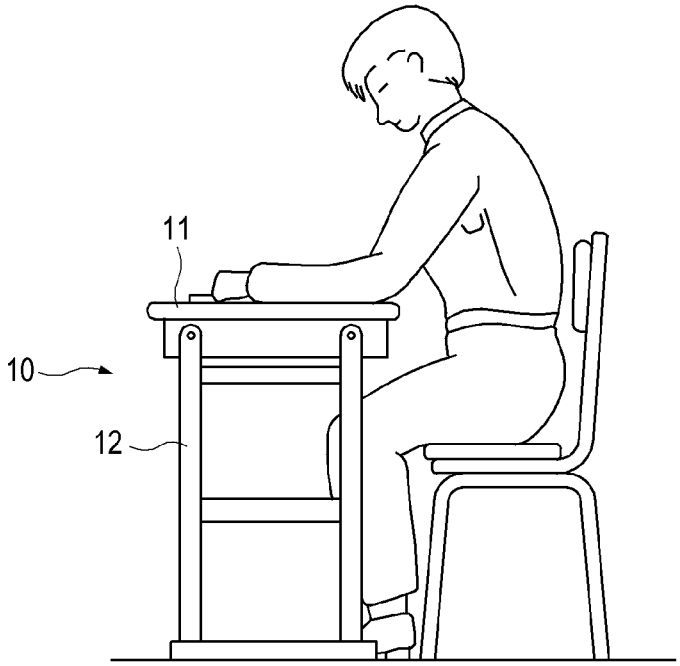
FIG. 1 is a side view showing an exemplary use of a conventional desk.
Figure 2:
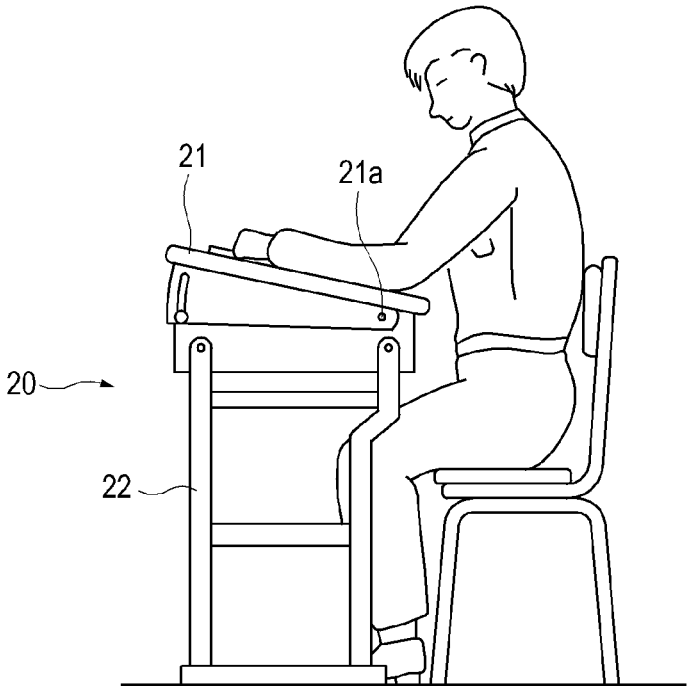
FIG. 2 is a side view showing another exemplary use of a conventional desk.
Figure 3:
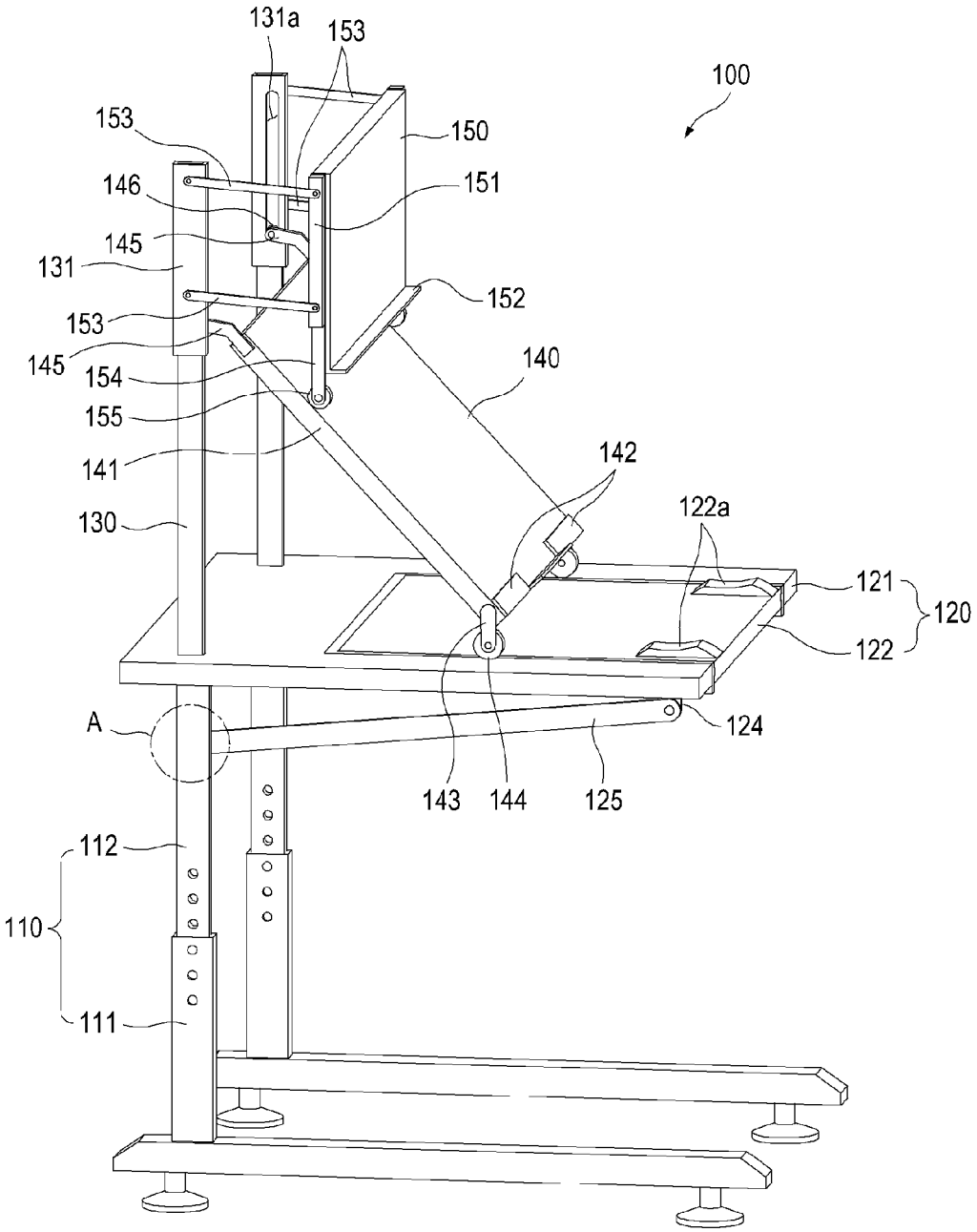
FIG. 3 is a perspective view showing a desk according to one embodiment of the present invention.

Referring to FIG. 3, a desk 100 according to one embodiment of the present invention includes support legs 110, an upper panel 120, support members 130, a movable panel 140 and a vertical panel 150. Through the following descriptions, a front side indicates the user side when the desk is used, while a rear side indicates an opposite side to the front side. Further, left and right directions indicate directions perpendicular to the front and rear sides. The upper panel 120 may have a front end, which is close to the user when using the desk, and a rear end that is opposite to the front end and is positioned farthest away from the user.

The support legs 110 serve to support the upper panel 120. To easily move the desk 100, lower ends of the support legs 110 may be provided with casters, which may be configured to stop by a lever. The support legs 110 may be configured as typical support legs for a desk. Alternatively, the support legs 110 may be configured such that a length of the support legs 110 may be adjusted. To this end, each support leg 110 has a lower leg 111 disposed on the ground and an upper leg 112 disposed on the lower leg 111. Any one of the lower leg 111 and the upper leg 112 may be configured to be inserted into the other. The upper leg 112 may move upward or downward with respect to the lower leg 111 by a drive means in an electric-powered manner. Accordingly, the user can use the desk while adjusting the length of the support legs 110 in accordance with his/her body type. As a result, a height of the upper panel 120 is adjusted. Further, the user can study or work as sitting or standing after adjusting the length of the support legs 110.

Figure 4:
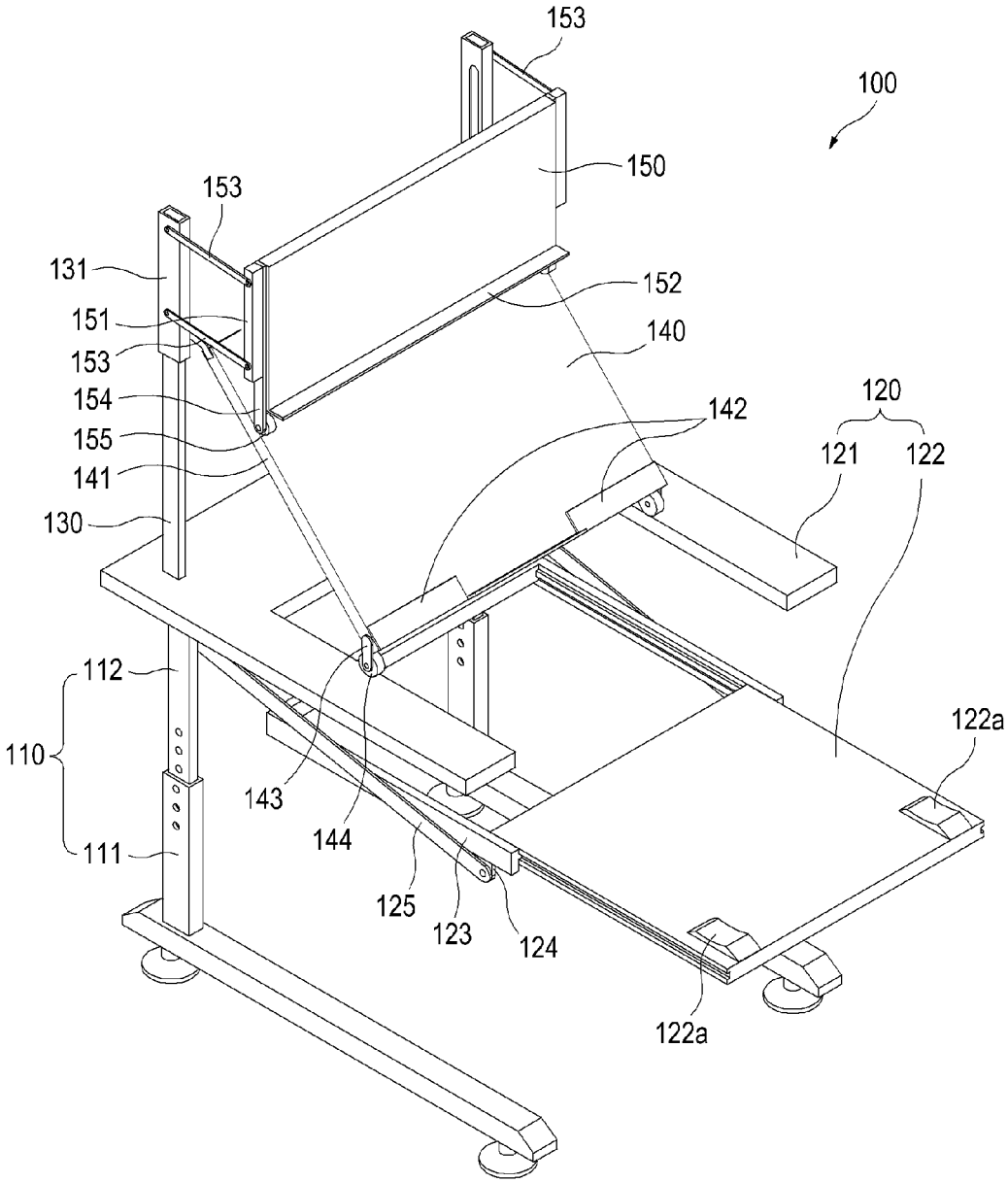
FIG. 4 is a perspective view showing an exemplary use of the desk shown in FIG. 3.

The upper panel 120 is coupled to upper sides of the support legs 110. The upper panel 120 may comprise a single panel or a plurality of panels. As shown in FIGS. 3 and 4, the upper panel 120 may include a first upper panel 121 and a second upper panel 122. The first upper panel 121 is fixed to the support legs 110 and supports a slide movement of the movable panel 140.

Figure 5:
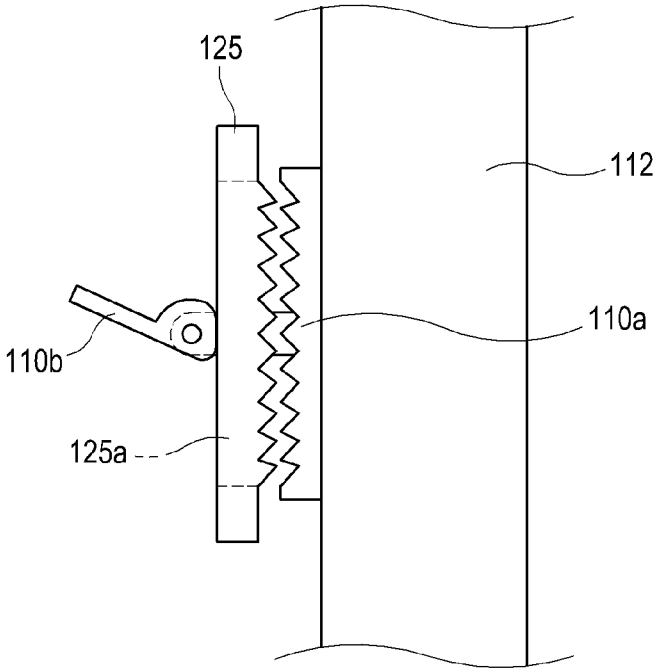
FIG. 5 is a view showing portion A of FIG. 3 when viewed from rear.

The second upper panel 122 is configured to be movable with respect to the first upper panel 121. As shown in FIGS. 3 to 5, the front and rear position, the vertical height and the slant degree of the second upper panel 122 may be adjusted with respect to the first upper panel 121. The second upper panel 122 is coupled to the support legs 110 through a second upper panel frame 123, support members 124 and support arms 125. The second upper panel frame 123 is coupled to both side ends of the second upper panel 122 such that the second upper panel 122 can slide forward and backward. The second upper panel 122 may slide by a drive means in an electric-powered manner. The support member 124 is coupled to a lower side of the second upper panel frame 123. A cushion member 122*a* for supporting the user's elbow may be mounted to a front side of the second upper panel 122. The cushion member 122*a* may be made from a silicon or latex material.

One end of each support arm 125 is rotatably coupled to each support leg 110, while the opposite end thereof is rotatably coupled to the support member 124. To this end, as shown in FIG. 5, a fixed circular disc 110*a* is affixed to the support leg 110, while a rotational circular disc 125*a*, which is in selective surface contact (or engagement) with the fixed circular disc 110*a*, is provided at one end of the support arm 125. In this case, the fixed circular disc 110*a* and the rotational circular disc 125*a* may be in surface contact with or spaced apart from each other through the rotation of a lever 110*b*. That is, if the fixed circular disc 110*a* is brought into surface contact with the rotational circular disc 125*a*, then one end of the support arm 125 is prevented from rotating. If the fixed circular disc 110*a* is spaced apart from the rotational circular disc 125*a*, then one end of the support arm 125 may be allowed to rotate. Further, such a configuration may be applied between the support member 124 and the opposite end of the support arm 125. Also, gear teeth may be formed at both ends of the support arm 125, while a drive motor and a gear meshing with the gear teeth may be provided at the support leg 110 or the support member 124. In this case, the position, height and slant degree of the second upper panel 122 may be adjusted in an electric-powered manner.

The support members 130 are vertically provided to both sides of the rear of the first upper panel 121. The support members 130 may comprise a rod of various shapes. Connection members 131 are coupled to upper sides of the support members 130. Thus, as the connection members 131 are coupled to the support members 130, guide channels 131*a* are formed in opposing surfaces of the connection members 131. The connection members 131 serve to connect the vertical panel 150 and to guide the movement of an upper end of the movable panel 140. Unlike the embodiment shown in the figures, the guide channel may be formed as a groove in the upper side of the support member 130. Dampers may be provided at upper and lower sides of the guide channel 131*a*. The dampers serve to relieve an impact, which occurs when the upper end of the movable panel 140 reaches the upper or lower side of the guide channel 131*a*.

The upper and lower ends of the movable panel 140 and a lower end of the vertical panel 150 include a moving member for providing a smooth movement. In the shown embodiment, rollers are provided in the upper and lower ends of the movable panel 140 and the lower end of the vertical panel 150 as the moving member, but the present invention is not limited thereto. For example, the moving member may comprise various types of rolling members and sliding members.

Movable panel frames 141 are coupled to both sides of the movable panel 140 and the movable panel 140 may be rotatably coupled to the movable panel frames 141. The movable panel 140 has an upper end, which is movable along the support members 130, and a lower end movably placed on the upper panel 120. The movable panel 140 can move between a first position (see FIGS. 3 and 4) inclined with respect to the upper panel 120 and a second position (see FIG. 6) vertical to the upper panel 120. Such a configuration can allow the user to utilize a space between the upper panel 120 and the movable panel 140. For example, books, notes, writing instruments, etc. may be kept in the space. A first stopper 142 for supporting the books or papers is provided at the lower end of the movable panel 140. In the embodiment shown in FIG. 3, a plurality of the first stoppers 142 are placed spaced apart from one another in a lengthwise direction of the movable panel 140. Further, the first stopper 142 may be foldably coupled to the lower end of the movable panel 140. Specifically, the first stopper 142 is configured to rotate between a position wherein the first stopper 142 and the movable panel 140 completely overlap each other and another position wherein the first stopper 142 is approximately perpendicular to the movable panel 140. Thus, when the first stopper 142 and the movable panel 140 overlap each other, the user can take notes on the book, papers or the like placed on movable panel 140. Further, the first stopper may comprise a single stopper, and the first stopper may be fixedly coupled to the movable panel 140 to be approximately perpendicular to the movable panel.

The lower end of the movable panel 140 is movable forward and backward on the upper panel 120, while the upper end of the movable panel 140 is movable upward and downward in the guide channel 131*a*. A slant angle of the movable panel 140 may be adjusted by the movement of the upper and lower ends of the movable panel 140.

A first roller 144 is mounted to a lower end of the movable panel frame 141 through a first arm 143. One end of the first arm 143 is fixedly or rotatably coupled to the lower end of the movable panel frame 141, while the first roller 144 is rotatably coupled to the opposite end of the first arm 143. The above-described rotation coupling configuration between the support arm 125 and the support leg 110 may be identically or similarly applied between one end of the first arm 143 and the movable panel frame 141. Further, the first arm 143 may be configured such that its length can be adjusted. For example, the first arm may comprise a fixed member coupled to the lower end of the movable panel frame and a movable member configured to be drawn out from the fixed member. Accordingly, the length adjustment and the rotation of the first arm 143 may adjust the height between the movable panel 140 and the upper panel 120 as well as the slant angle of the movable panel 140.

One end of a second arm 145 is fixedly coupled to the upper end of the movable panel frame 141. A second roller 146 is rotatably coupled to the opposite end of the second arm 145.

Vertical panel frames 151 are coupled to both sides of the vertical panel 150 and the vertical panel 150 is rotatably coupled to the vertical panel frames 151. The vertical panel 150 is rotatably joined to the support members 130 and is movably placed on the movable panel 140 at its lower end. The vertical panel moves along with or in concomitance with the movement of the movable panel 140. Such a configuration may allow a rear space of the vertical panel 150 to be utilized. For example, a bookshelf may be provided in the rear space of the vertical panel 150. A second stopper 152 for supporting books or papers is provided at the lower end of the vertical panel 150. The second stopper 152 may be configured identically or similarly to the first stopper 142 provided at the lower end of the movable panel 140.

The vertical panel 150 is joined to the connection members 131 through the vertical panel frames 151 and a plurality of link arms 153. One end of the link arm 153 is rotatably coupled to the connection member 131, while the opposite end is rotatably coupled to the vertical panel frame 151. Thus, the vertical panel 150 is movable upward and downward while maintaining a parallel state with respect to the support members 130. A distance between the connection member 131 and the vertical panel frame 151 may be adjusted by changing a position at which one end of the link arm 153 is coupled to the connection member 131 or a position at which the opposite end of the link arm 153 is coupled to the vertical panel 150. Alternatively, the link arm 153 may be configured to be extendable and retractable.

The lower end of the vertical panel 150 is movable upward or downward on the movable panel 140. A third roller 155 is mounted to a lower end of the vertical panel frame 151 through a third arm 154. One end of the third arm 154 is affixed to the vertical panel frame 151, while the third roller 155 is rotatably coupled to the opposite end of the third arm 154. The third arm 154 may be configured such that its length can be adjusted. For example, the third arm may comprise a fixed member coupled to the lower end of the vertical panel frame 151 and a movable member configured to be drawn out from the fixed member. Thus, the height between the vertical panel 150 and the movable panel 140 as well as the height of the vertical panel 150 may be adjusted.

If the lower end (e.g., first roller 144) of the movable panel 140 moves backward along the upper panel 120 or the upper end (e.g., the second roller 146) of the movable panel moves upward in the guide channel 131*a*, then the lower end (e.g., the third roller 155) of the vertical panel 150 moves downward and forward along the movable panel 140. In this case, the vertical panel 150 approaches the support members 130 while being parallel to the support members 130. If the lower end of the movable panel 140 moves forward along the upper panel 120 or the upper end of the movable panel moves downward in the guide channel 131*a*, then the lower end of the vertical panel 150 moves upward and backward along the movable panel 140. In this case, the vertical panel 150 moves away from the support members 130 while being parallel to the support members 130.

Figure 6:
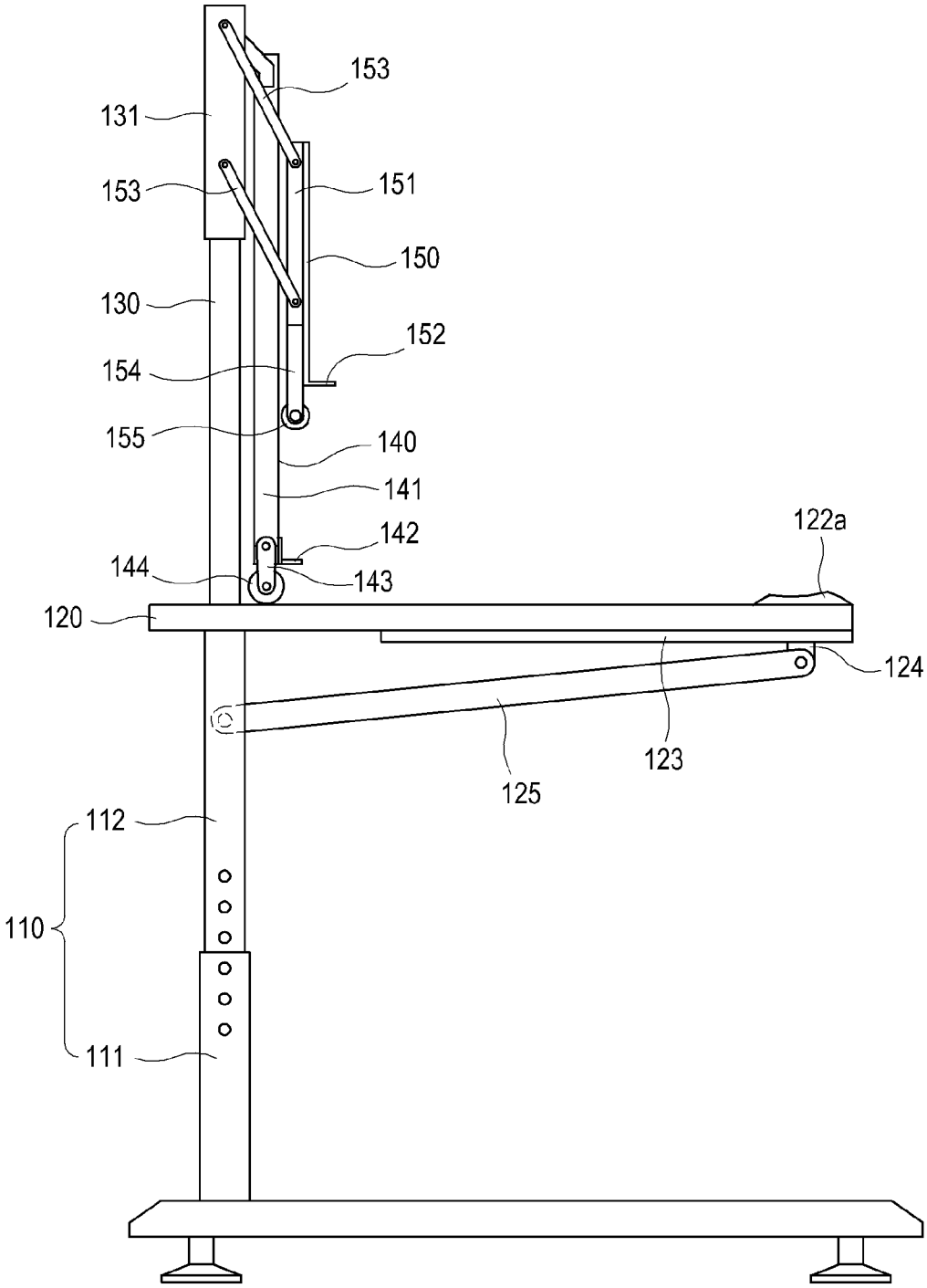
FIG. 6 is a perspective view showing another exemplary use of the desk shown in FIG. 3.

The user can study or work with books, papers or the like that are placed on the movable panel 140 and the vertical panel 150 in a state shown in FIG. 3. For example, the user can look at the vertical panel 150 while maintaining a correct posture wherein the ear, the shoulder and the coxa are vertically positioned on the ground. Further, the user can look at the movable panel 140 with his/her head bowed slightly. That is, even in the case of using the movable panel 140 and the vertical panel 150 together, the user can minimize the shift of his/her eyesight, thus improving work efficiency. When not using the movable panel 140, the user moves the lower end of the movable panel 140 backward and then can overlap or juxtapose the movable panel 140 and the vertical panel 150 one behind the other in a direction vertical to the upper panel 120, as shown in FIG. 6. In this case, the first arm 143 is rotated and then can form an approximately straight line with the movable panel frame 141. In the state shown in FIG. 6, the user can also study or work while using the upper panel 120 and the vertical panel 150. Further, the user can adjust the slant angle of the movable panel 140 in accordance with his/her body type or posture and use the movable panel. The height of the vertical panel 150 is adjusted through the adjustment of the slant angle of the movable panel 140. Furthermore, as shown in FIG. 4, the user can adjust the forward and backward position, the vertical height and the slant degree of the second upper panel 122 and then use the second upper panel.

To minimize frictional noise during a rolling movement of the first to third rollers 144, 146, 155, the first to third rollers 144, 146, 155 may be made from a material such as rubber, silicon or the like. Alternatively, an outer peripheral surface of the first to third rollers 144, 146, 155 may be coated with a material such as rubber, silicon or the like.

In this embodiment, the drive means includes a hydraulic or pneumatic actuator, a belt and a pulley, rack and pinion gears, a ball screw or the like.

Figure 7:
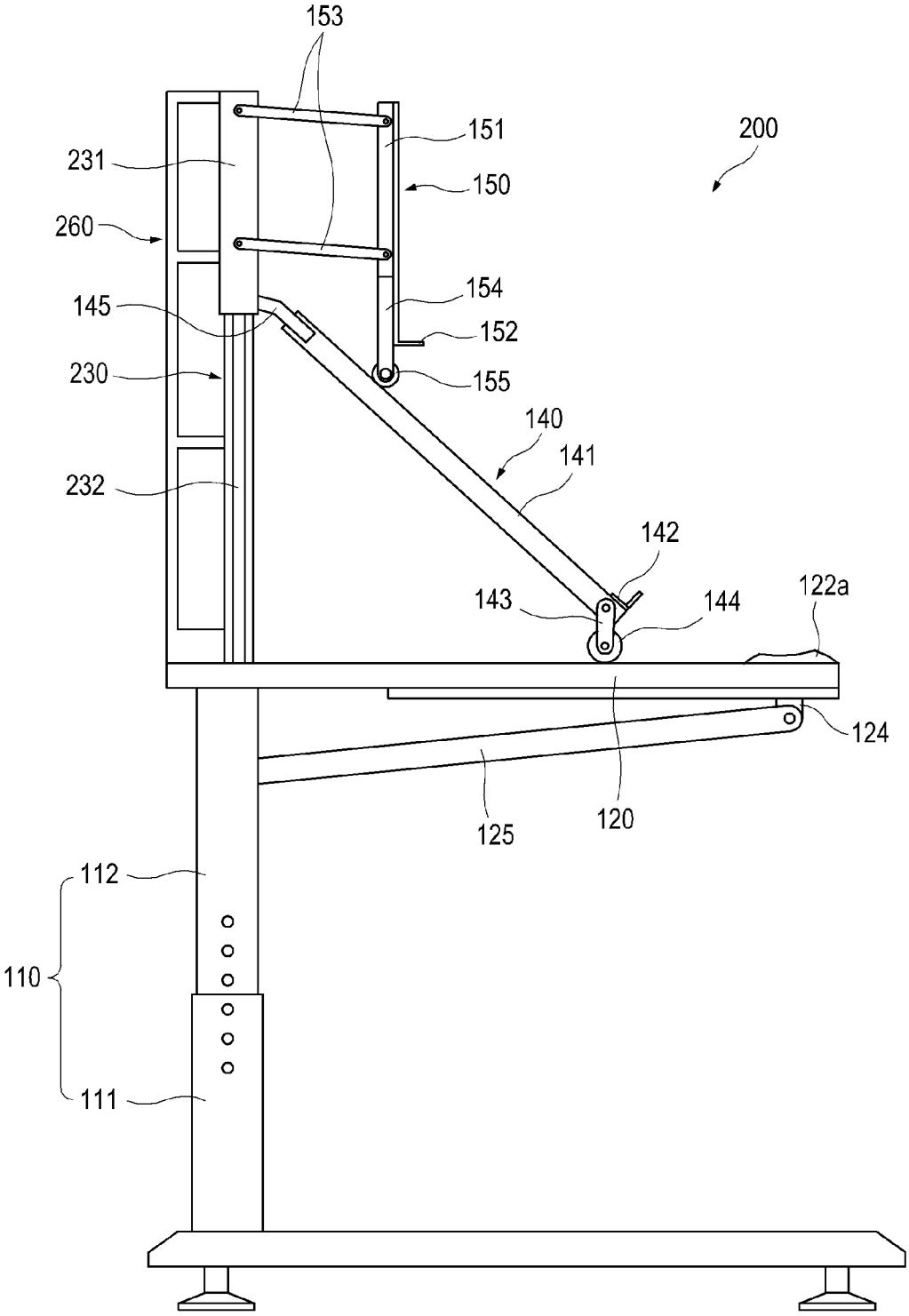
FIG. 7 is a side elevational view showing a desk according to another embodiment of the present invention.
Figure 8:
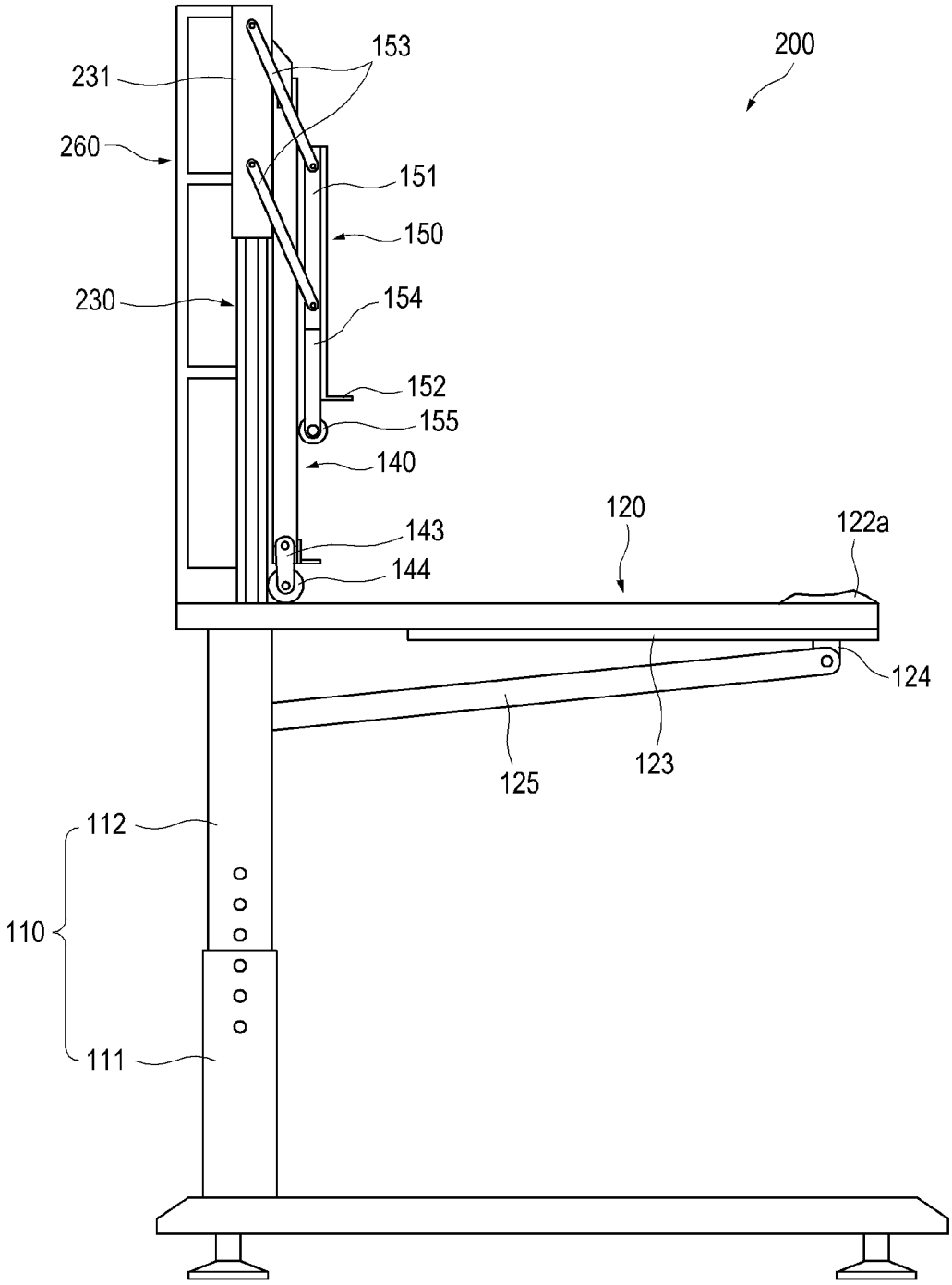
FIG. 8 is a side elevational view showing an exemplary use of the desk shown in FIG. 7.
Figure 9:
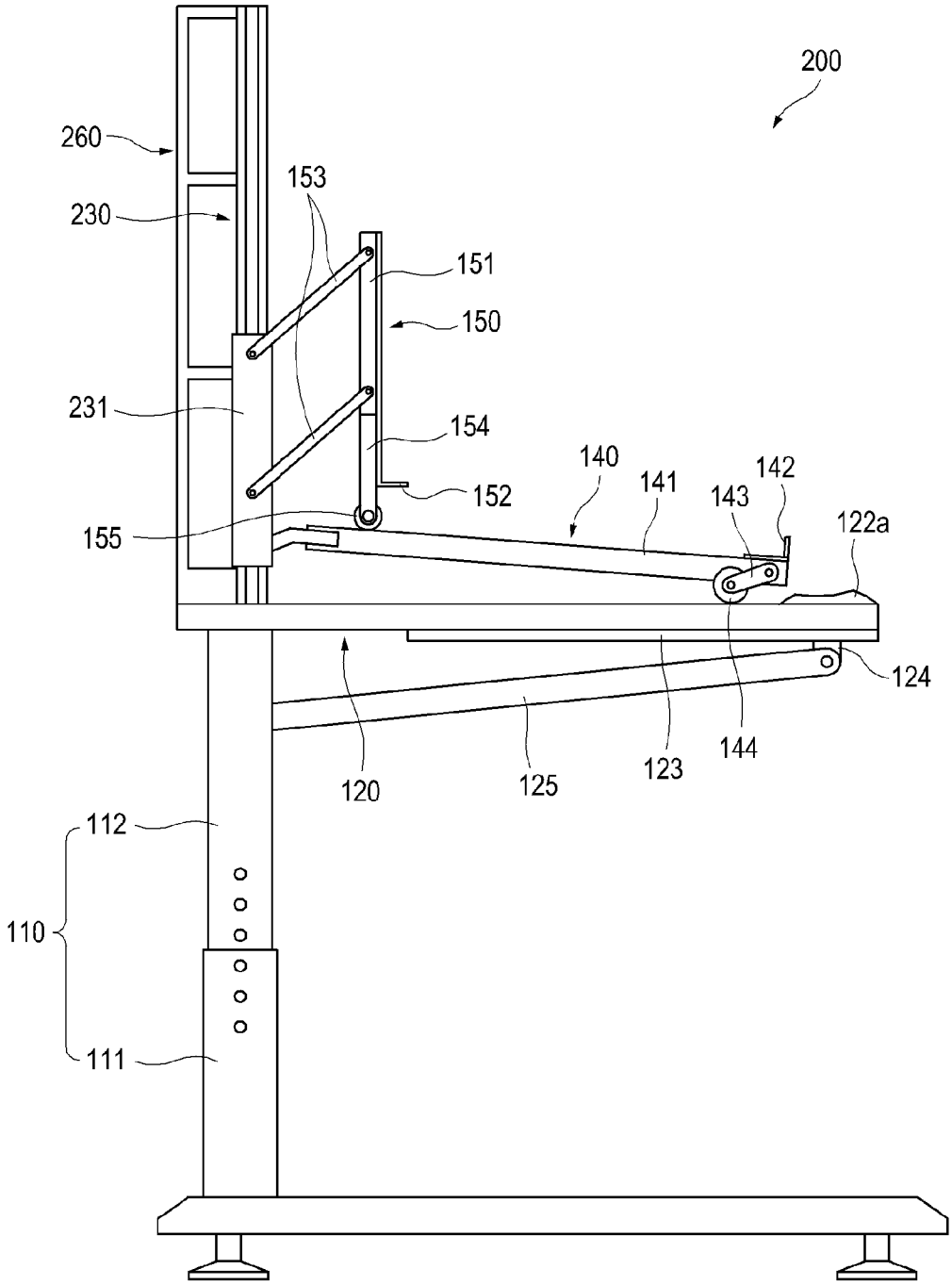
FIG. 9 is a perspective view showing another exemplary use of the desk shown in FIG. 7.

Referring to FIGS. 7 to 9, a desk 200 according to another embodiment of the present invention includes the support legs 110, the upper panel 120, support members 230, the movable panel 140, the vertical panel 150 and a bookshelf 260. The desk 200 of this embodiment has a configuration identical or similar to that of the desk 100 of the embodiment shown in FIGS. 3 to 6, except for the configuration of the support members 230 and the bookshelf 260. Accordingly, the support members 230 and the bookshelf 260 will be described in detail in this embodiment.

The support members 230 are vertically provided in the rear of the upper panel 120. Connection members 231 are upward and downward slidably coupled to the support members 230. To this end, the support members 230 are formed with a guide member 232 for a sliding movement of the connection member 231. The movable panel 140 is movable between a first position (see FIG. 7) inclined with respect to the upper panel 120 and a second position (see FIG. 8) vertical to the upper panel 120 as well as between the first position and a third position (see FIG. 9) parallel to the upper panel 120. Thus, as the movable panel 140 moves between the first position and the second position and between the first position and the third position, the connection members 231 slide upward or downward along the guide members 232. Simultaneously, the lower end of the vertical panel 150 moves downward or upward along the movable panel 140. Further, the connection members 231 may move upward or downward by a drive means in an electric-powered manner. In this case, the slant angle of the movable panel 140 and the height of the vertical panel 150 are adjusted through the movement of the connection members 231. For example, the drive means may include a hydraulic or pneumatic actuator, a belt and a pulley, rack pinion gears, a ball screw or the like.

The bookshelf 260 may have a plurality of shelves and be disposed in the rear of the support members 230. In the state shown in FIG. 7, the user can rotate the movable panel 140 upward with respect to the movable panel frames 141 or rotate the vertical panel 150 forward with respect to the vertical panel frames 151 to thereby use the bookshelf 260. Further, as shown in FIG. 9, the user can use the bookshelf 260 in a state where the connection members 231 are moved downward. In this case, the first arm 143 is rotated and can be disposed approximately parallel to the upper panel 120. If the lower end of the movable panel 140 moves backward toward the support members 230, then the movable panel 140 and the vertical panel 150 are juxtaposed one behind the other as shown in FIG. 8.

Figure 10:
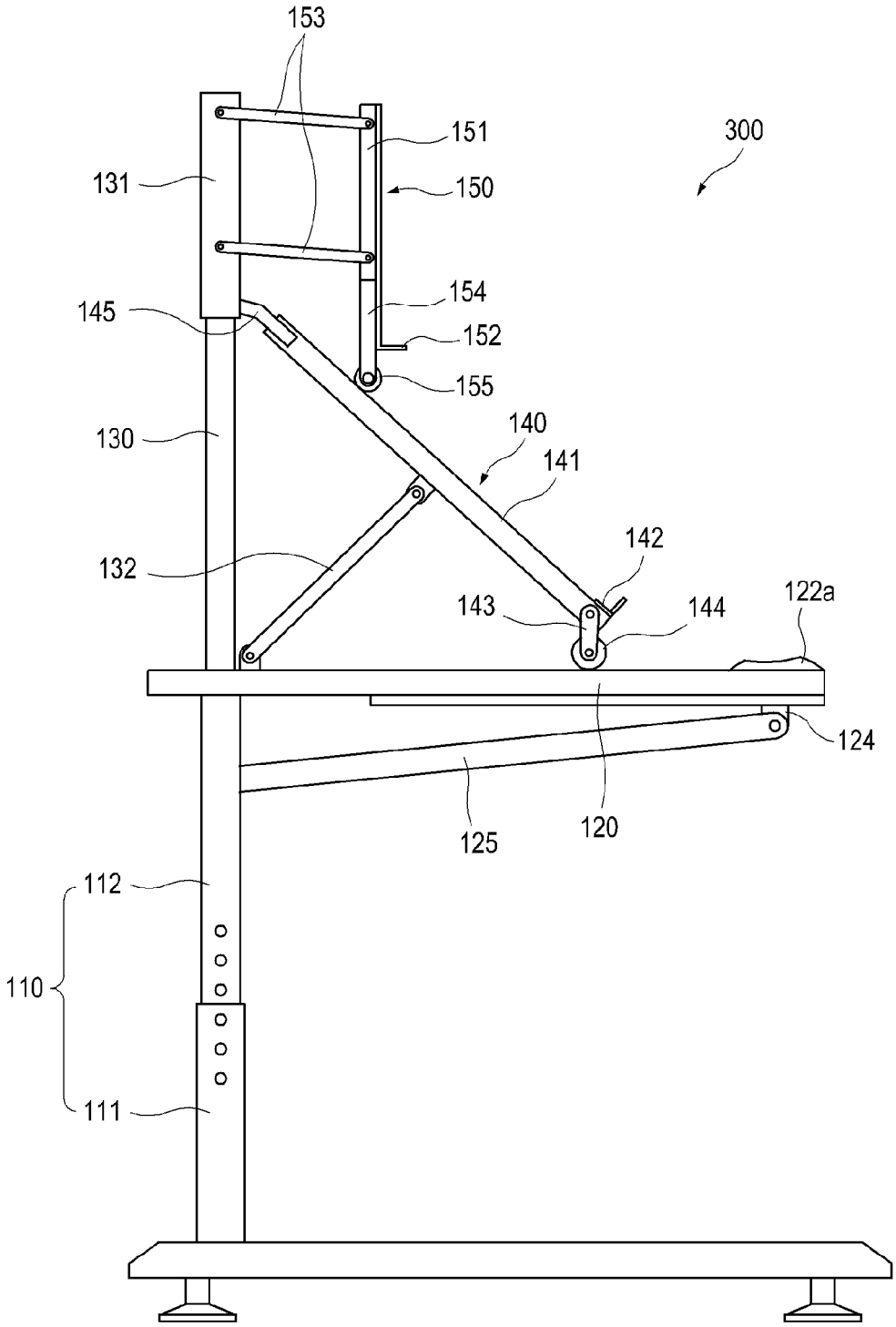
FIG. 10 is a side elevational view showing a desk according to a further embodiment of the present invention.

Referring to FIG. 10, a desk 300 according to a further embodiment of the present invention includes the support legs 110, the upper panel 120, the support members 130, the movable panel 140, the vertical panel 150 and a second support member 132. The movable panel 140 is movable between a first position (see FIG. 10) inclined with respect to the upper panel 120 and a second position vertical to the upper panel 120. One end the second support member 132 may be hinge-coupled to the upper panel 120, while the opposite end of the second support member may be hinge-coupled to a backside of the movable panel 140. Further, one end of each of two second support members 132 may be hinge-coupled to the upper panel 120, while their opposite ends may be hinge-coupled to the movable panel frames 141 respectively. Thus, if the upper end of the movable panel 140 moves upward and the lower end thereof moves backward, then the second support member 132 becomes vertical to the upper panel 120. Further, the desk 300 may include a drive means for pivoting the one end of the second support member 132. The drive means may include a drive motor, a drive gear coupled to a rotating shaft of the drive motor and gear teeth formed at the one end of the second support member 132. The desk 300 of this embodiment has a configuration identical or similar to that of the desk 100 of the embodiment shown in FIGS. 3 to 6, except for the hinge configuration of the upper panel 120 and the movable panel 140.

Figure 11:
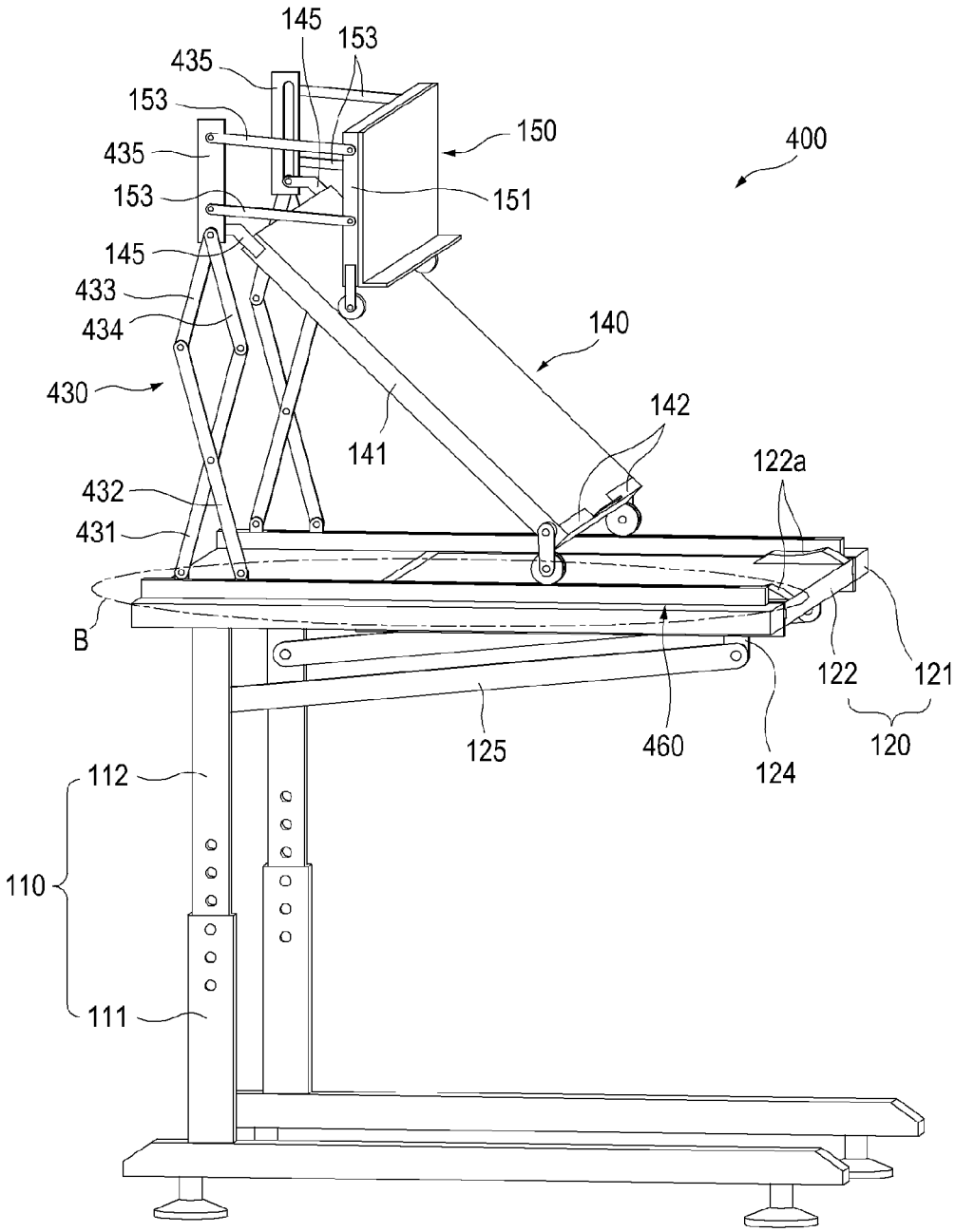
FIG. 11 is a perspective view showing a desk according to yet another embodiment of the present invention.
Figure 12:
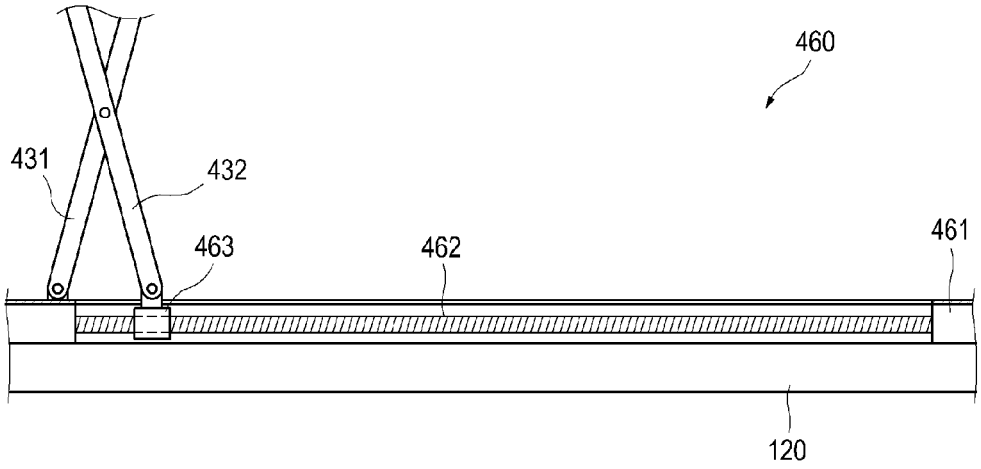
FIG. 12 is an enlarged view showing portion B of FIG. 11.
Figure 13:
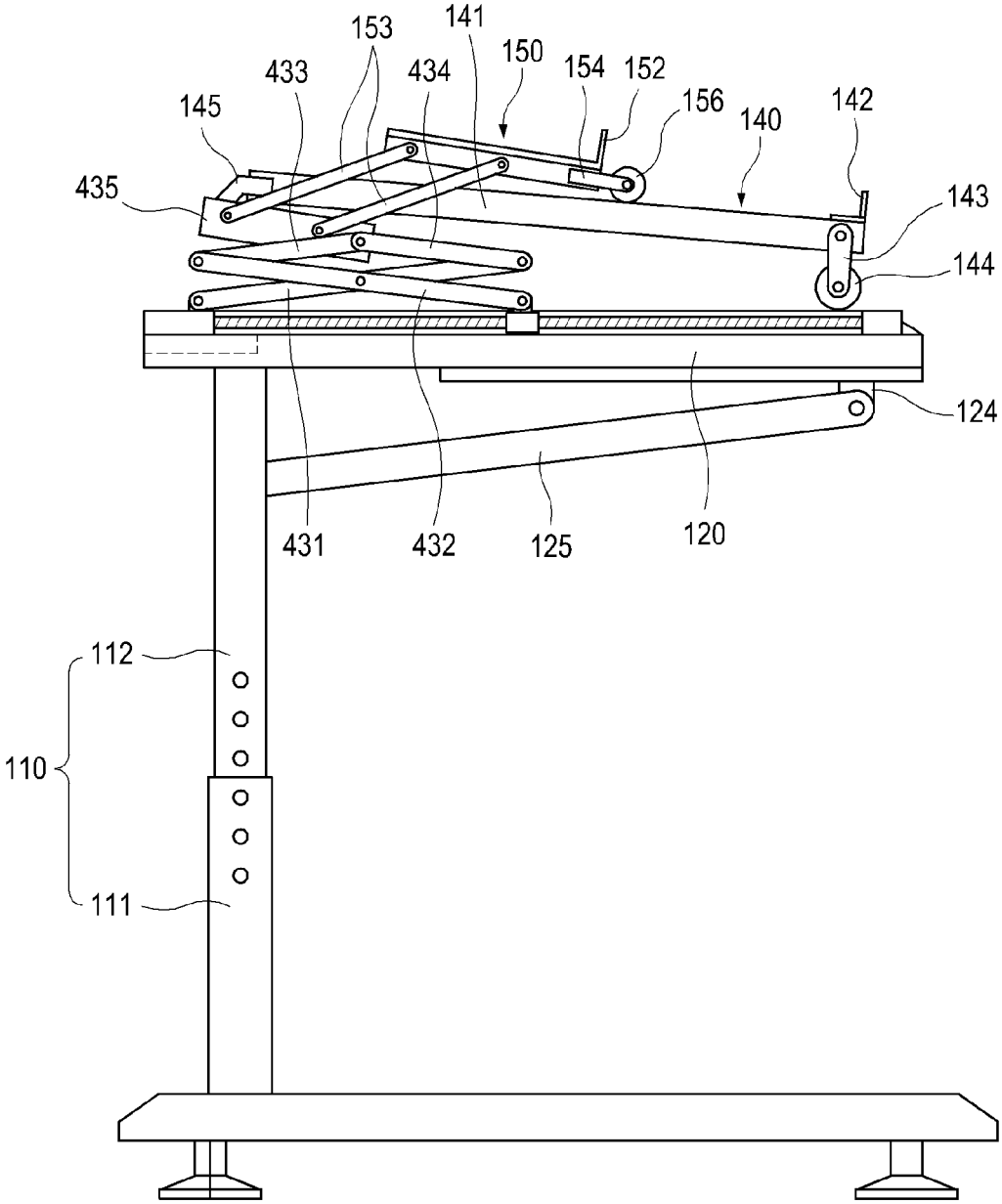
FIG. 13 is a side elevational view showing an exemplary use of the desk shown in FIG. 11.

Referring to FIGS. 11 to 13, a desk 400 according to a still further embodiment of the present invention includes the support legs 110, the upper panel 120, support members 430, the movable panel 140, the vertical panel 150 and a drive means 460. The desk 400 of this embodiment has a configuration identical or similar to that of the desk 100 of the embodiment shown in FIGS. 3 to 6, except for the configuration of the support member 430 and the drive means 460. Thus, the support member 430 and the drive means 460 will be described below in detail in this embodiment.

As shown in FIG. 11, each support member 430 may include first to fourth link members 431, 432, 433, 434 and a connection member 435. A lower end of the first link member 431 is hinge-coupled to the upper panel 120 and a lower end of the second link member 432 is movable forward and backward on the upper panel 120. The first and the second link member 431, 432 are hinge-coupled to each other to intersect at an approximate halfway position thereof. An upper end of the first link member 431 is hinge-coupled to a lower end of the fourth link member 434, while an upper end of the second link member 432 is hinge-coupled to a lower end of the third link member 433. An upper end of the third link member 433 is hinge-coupled to an upper end of the fourth link member 434. The connection member 435 is coupled to the upper side of the fourth link member 434 such that it is always in a straight line with the fourth link member 434. The connection members 435 of this embodiment correspond to the connection member 131 of the embodiment shown in FIGS. 3 to 6.

As shown in FIG. 12, the drive means 460 may include a drive motor 461, a screw shaft 462 and a nut member 463. The drive motor 461 is affixed in a forward or backward position of the upper panel 120. The screw shaft 462 is coupled to a rotating shaft of the drive motor 461. The nut member 463 is threadedly coupled to the screw shaft 462 and a plurality of balls are interposed between the screw shaft 462 and the nut member 463. In this embodiment, the lower end of the second link member 432 is hinge-coupled to an upper side of the nut member 463. Accordingly, as the drive motor 461 operates, the nut member 463 is threadedly moved along the screw shaft 462. The drive means of the present invention is not limited to the drive motor and a ball screw, but may include a hydraulic or pneumatic actuator, a belt and a pulley, rack and pinion gears or and the like.

The movable panel 140 is movable between a first position (see FIG. 11) inclined with respect to the upper panel 120 and a second position vertical to the upper panel 120 as well as between the first position and a third position (see FIG. 13) parallel to the upper panel 120.

For example, if the drive motor 461 operates in one direction, the lower end of the second link member 432 hinge-coupled to the nut member 463 moves away from the lower end of the first link member 431. Then, the support member 430 is folded downward to thereby move the connection member 435 downward. Simultaneously, the lower end of the movable panel 140 moves forward, while the upper end thereof moves upward in the connection member 435. In addition, the lower end of the vertical panel 150 moves downward and forward along with the movable panel 140. As a result, as shown in FIG. 13, the movable panel 140 and the vertical panel 150 are juxtaposed to be approximately parallel to the upper panel 120. In this case, the first arm 143 is rotated and then positioned approximately vertically to the movable panel frame 141. If the drive motor 461 operates in an opposite direction to the above direction, then the lower end of the second link member 432 hinge-coupled to the nut member 463 moves toward the lower end of the first link member 431. Thus, the support member 430 is stretched out upward to thereby move the connection member 435 upward. Simultaneously, the lower end of the movable panel 140 moves backward, while the upper end thereof moves upward in the connection members 435. In addition, the lower end of the vertical panel 150 moves backward and upward along with the movable panel 140. As a result, the desk 400 of this embodiment goes into the state shown in FIG. 11.

Figure 14:
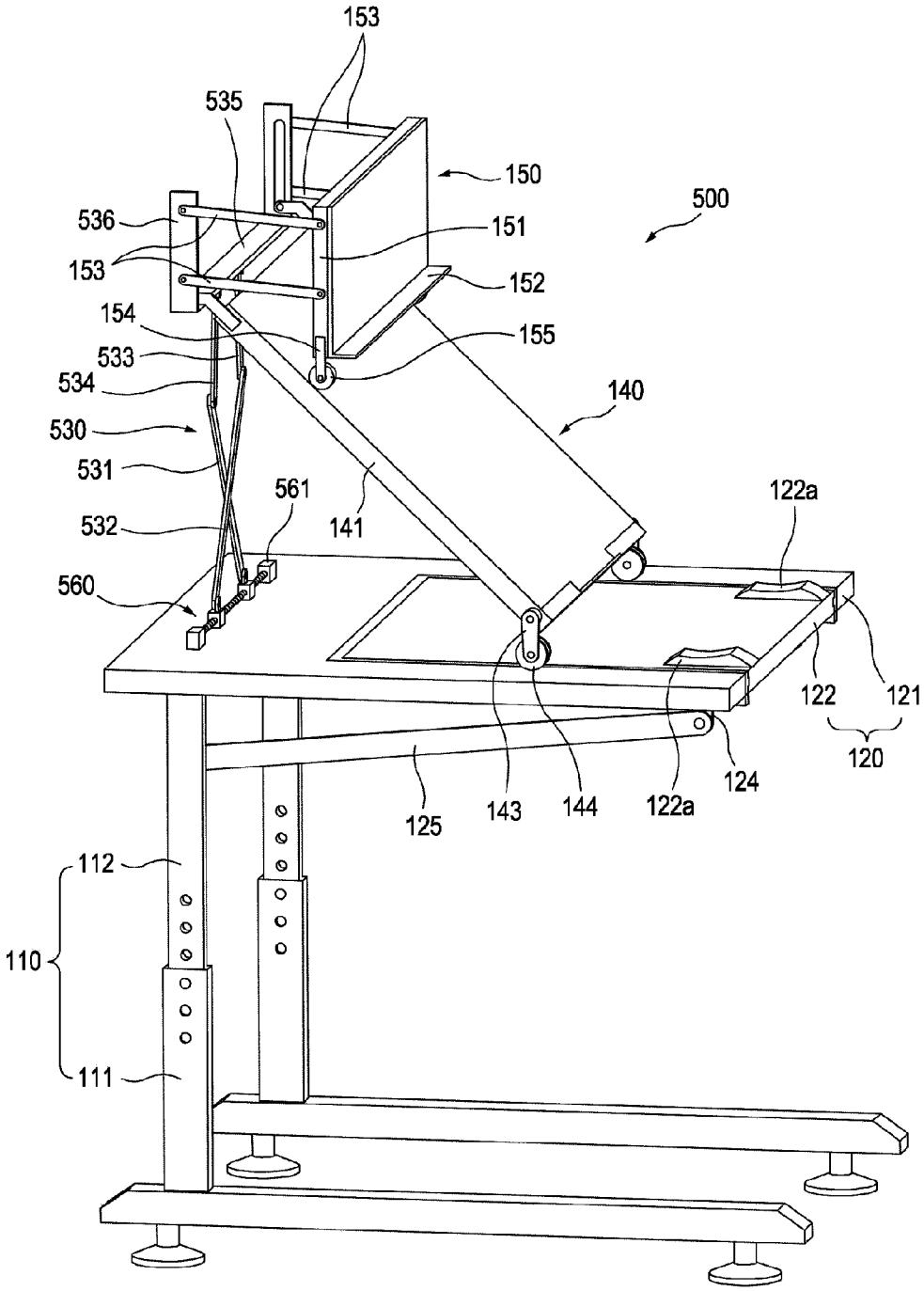
FIG. 14 is a perspective view showing a desk according to a still further embodiment of the present invention.
Figure 15:
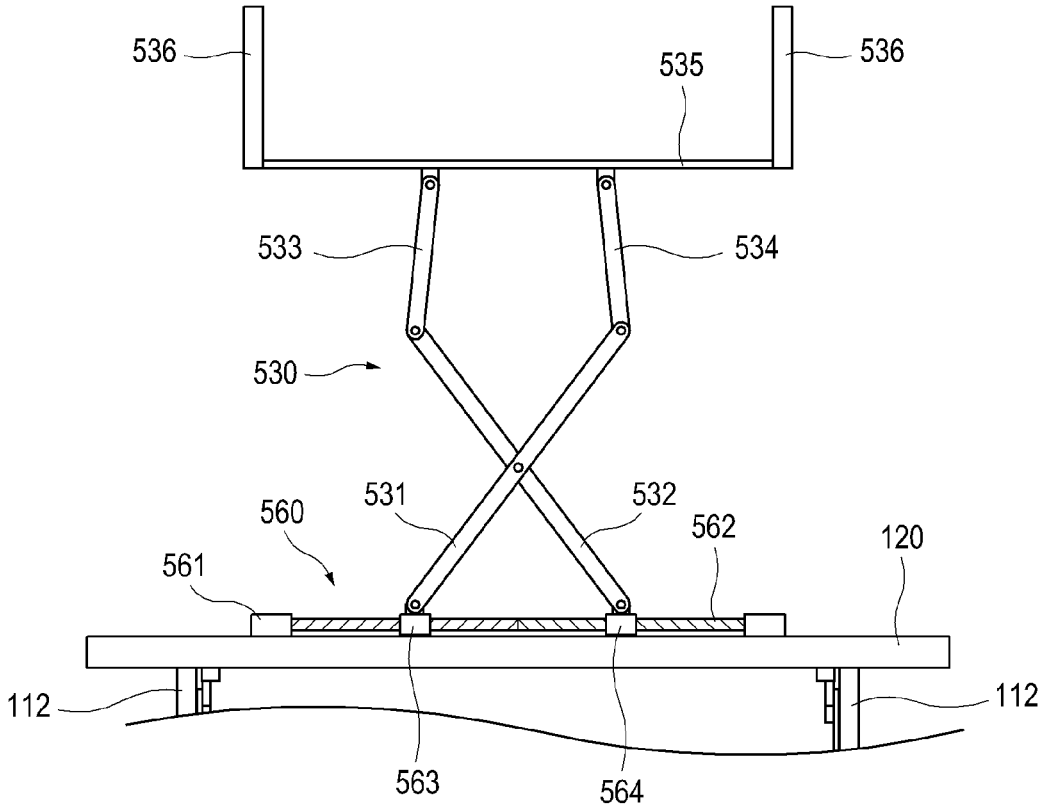
FIG. 15 is a schematic view of the desk shown in FIG. 14 when viewed from rear.

Referring to FIGS. 14 and 15, a desk 500 according to a still further embodiment of the present invention includes the support legs 110, the upper panel 120, a support member 530, the movable panel 140, the vertical panel 150 and a drive means 560. The desk 500 of this embodiment has a configuration identical or similar to that of the desk 100 of the embodiment shown in FIGS. 3 to 6, except for the configuration of the support member 530 and the drive means 560. Thus, the support member 530 and the drive means 560 will be described below in detail in this embodiment.

As shown in FIGS. 14 and 15, the support member 530 may include first to fourth link members 531, 532, 533, 534, a horizontal bar 535 and connection members 536. Lower ends of the first and second link members 531 and 532 are movable on the upper panel 120 in left and right directions. The first and second link members 531 and 532 are hinge-coupled to each other to intersect at an approximate halfway position thereof. An upper end of the first link member 531 is hinge-coupled to a lower end of the fourth link member 534, while an upper end of the second link member 532 is hinge-coupled to a lower end of the third link member 533. Upper ends of the third and fourth link members 533 and 534 are hinge-coupled to a lower side of the horizontal bar 535, respectively. The connection members 536 are vertically coupled to both ends of the horizontal bar 535. The connection members 536 correspond to the support members 130 of the embodiment shown in FIGS. 3 to 6.

The drive means 560 may include a drive motor 561, a screw shaft 562 and first and second nut members 563, 564. The drive motor 561 is affixed in a left or right side of the upper panel 120. The screw shaft 562 is coupled to a rotating shaft of the drive motor 561. The first nut member 563 is threadedly coupled to the screw shaft 562 and a plurality of balls are interposed between the screw shaft 562 and the first nut member 563. The second nut member 564 is not threadedly coupled to the screw shaft 562, but is configured to move along the 562. In this embodiment, the lower end of the first link member 531 is hinge-coupled to an upper side of the first nut member 563, while the lower end of the second link member 532 is hinge-coupled to an upper side of the second nut member 563. Thus, as the drive motor 561 operates, the first nut member 564 threadedly moves along the screw shaft 562. In addition, the second nut member 564 moves along the screw shaft 562 through the interaction between the first and second link members 531 and 532. The drive means according to the present invention is not limited to the drive motor and a ball screw, but may include a hydraulic or pneumatic actuator, a belt and a pulley, rack and pinion gear or the like.

For example, if the drive motor 561 operates in one direction, the lower end of the first link member 531 hinge-coupled to the first nut member 563 and the lower end of the second link member 532 hinge-coupled to the second nut member 564 move away from each other. Thus, the support member 530 is folded downward to thereby move both the horizontal bar 535 and the connection members 536 downward. Simultaneously, the lower end of the movable panel 140 moves forward, while the upper end of the movable panel 140 moves upward in the connection members 536. In addition, the lower end of the vertical panel 150 moves downward and forward along with the movable panel 140. As a result, the movable panel 140 may be disposed approximately parallel to the upper panel 120, and the vertical panel 150 may be disposed as inclined with respect to the movable panel 140. If the drive motor 561 operates in an opposite direction to the above direction, the lower end of the first link member 531 hinge-coupled to the first nut member 563 and the lower end of the second link member 532 hinge-coupled to the second nut member 564 move toward each another. Thus, the support member 530 is stretched out upward, thereby moving both the horizontal bar 535 and the connection members 536 upward. Simultaneously, the lower end of the movable panel 140 moves backward, while the upper end thereof moves upward in the connection members 536. In addition, the lower end of the vertical panel 150 moves backward and upward along with the movable panel 140. As a result, the movable panel 140 and the vertical panel 150 go into the state shown in FIG. 14.

Figure 16:
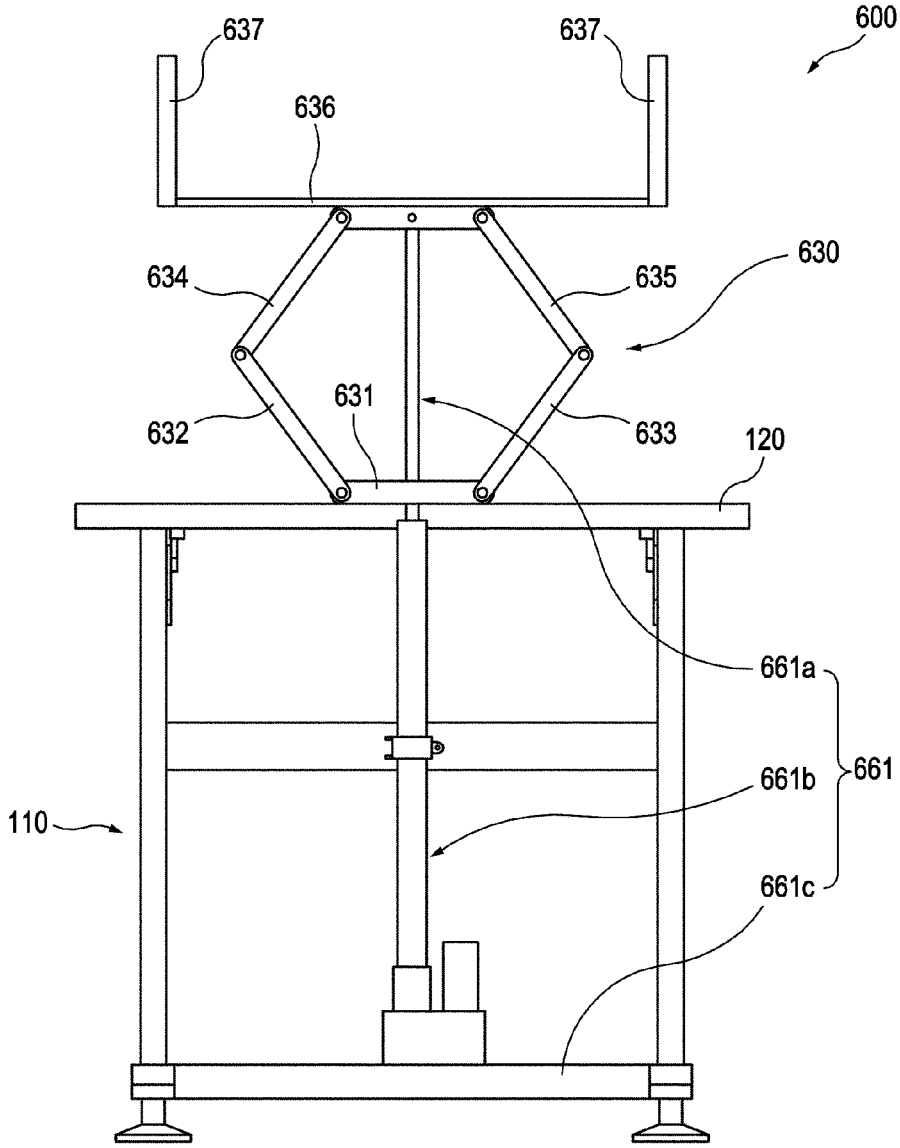
FIG. 16 is a rear view showing a desk according to yet another embodiment of the present invention.
Figure 17:
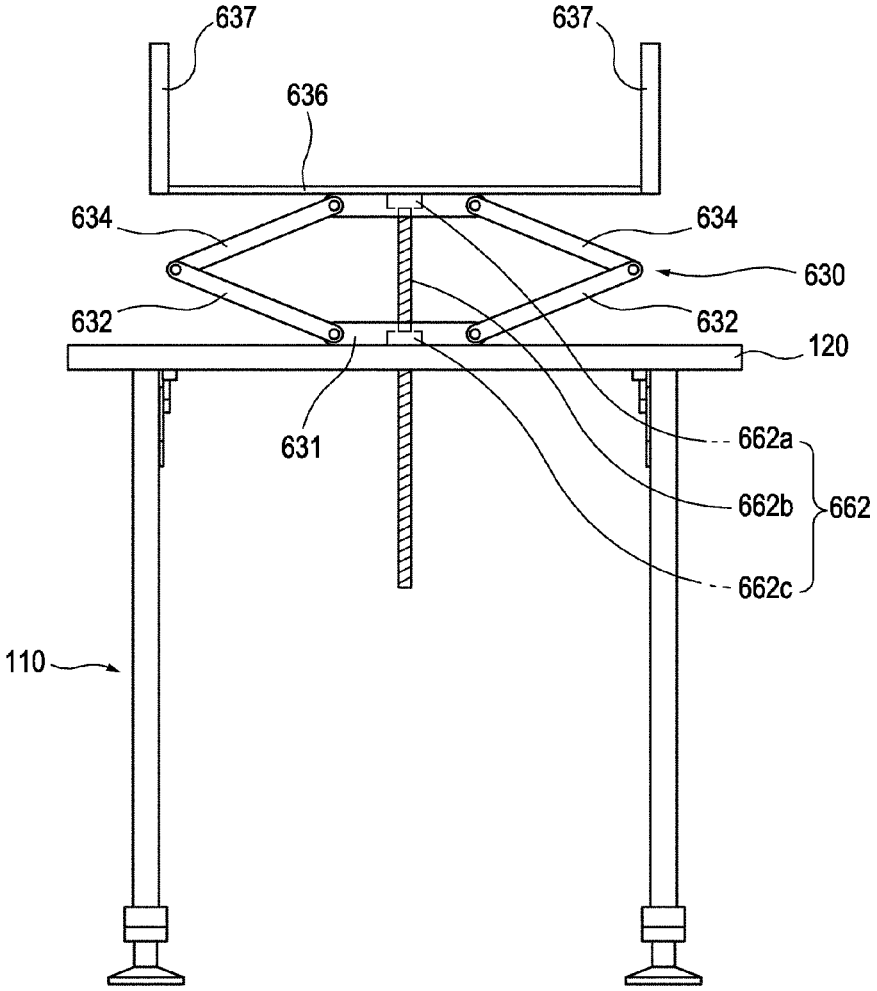
FIG. 17 is a rear view showing a desk according to yet another embodiment of the present invention.

Referring to FIGS. 16 and 17, a desk 600 according to a still further embodiment of the present invention includes the support legs 110, the upper panel 120, a support member 630 and a drive means 661, 662. The desk 600 of this embodiment has a configuration identical or similar to that of the desk 500 according to the embodiment shown in FIGS. 14 and 15, except for the configuration of the support member 630 and the drive means 661, 662. Thus, the support member 630 and the drive means 661, 662 will be described in detail in this embodiment.

As shown in FIGS. 16 and 17, the support member 630 includes a first horizontal bar 631, first to fourth link members 632, 633, 634, 635, a second horizontal bar 636, and connection members 637. The first horizontal bar 631 is coupled to the upper panel 120. Lower ends of the first and second link members 632 and 633 are hinge-coupled to both ends of the first horizontal bar 631, respectively. Lower ends of the third and fourth link members 634 and 635 are hinge-coupled to upper ends of the first and second link members 632 and 633, respectively. Upper ends of the third and fourth link members 634 and 635 are hinge-coupled to a lower side of the second horizontal bar 636, respectively. The connection members 637 are vertically coupled to both ends of the second horizontal bar 636.

As shown in FIG. 16, the drive means 661 has a plunger 661*a* coupled to the lower side of the second horizontal bar 636, and a hydraulic or pneumatic actuator 661*b* coupled to a lower side of the desk 600. The hydraulic or pneumatic actuator 661*b* is coupled to a support panel 661*c* disposed between the support legs 110. Accordingly, the second horizontal bar 636 and the connection members 637 is movable upward or downward by the operation of the hydraulic or pneumatic actuator 661*b*. Herein, it should be appreciated that the hydraulic or pneumatic actuator includes a hydraulic drive device or a pneumatic drive device.

As shown in FIG. 17, the drive means 662 includes a drive motor 662*a* coupled to the lower side of the second horizontal bar 636, a screw shaft 662*b* coupled to a rotating shaft of the drive motor 662*a* and a nut member 662*c* coupled to the first horizontal bar 631 and threadedly coupled to the screw shaft 662*b*. The second horizontal bar 636 and the connection members 637 are movable upward and downward by the operation of the drive motor 662*a*.

Figure 18:
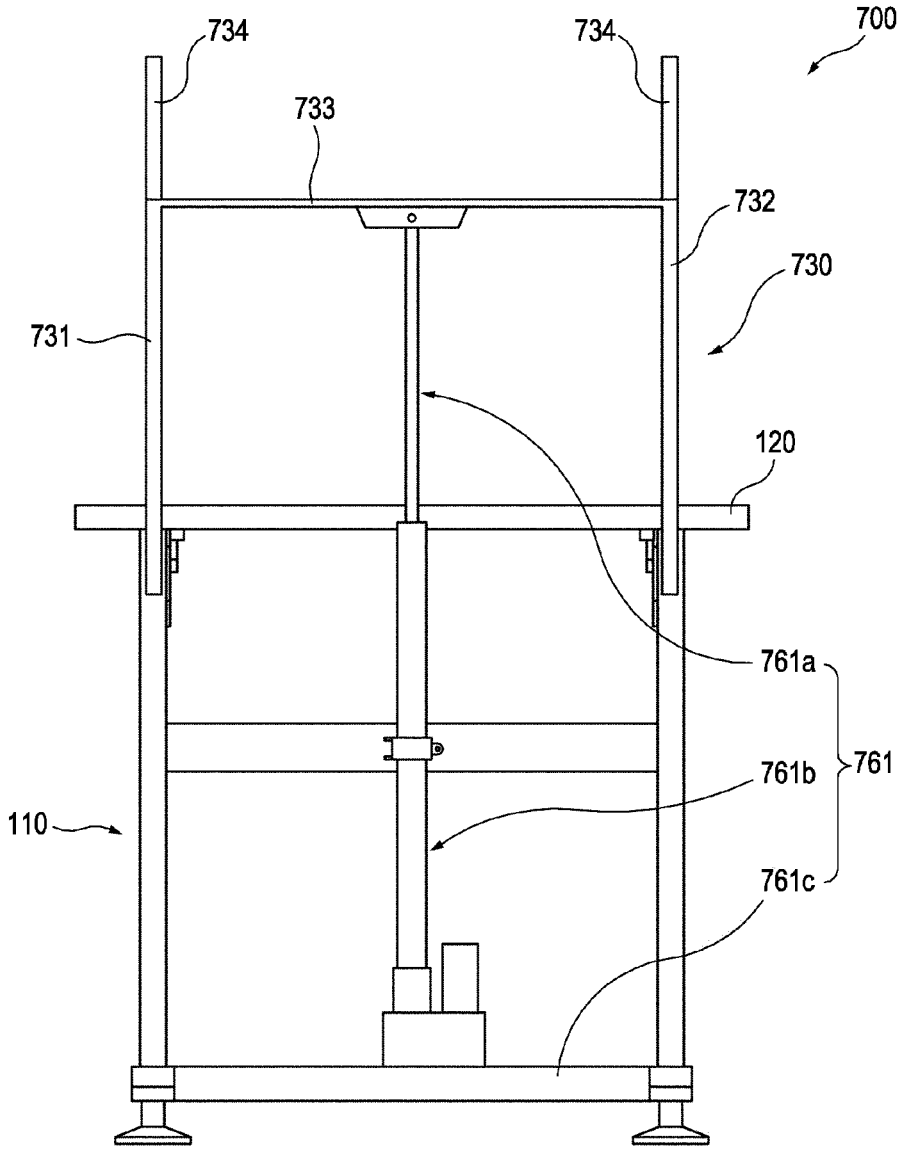
FIG. 18 is a rear view showing a desk according to yet another embodiment of the present invention.
Figure 19:
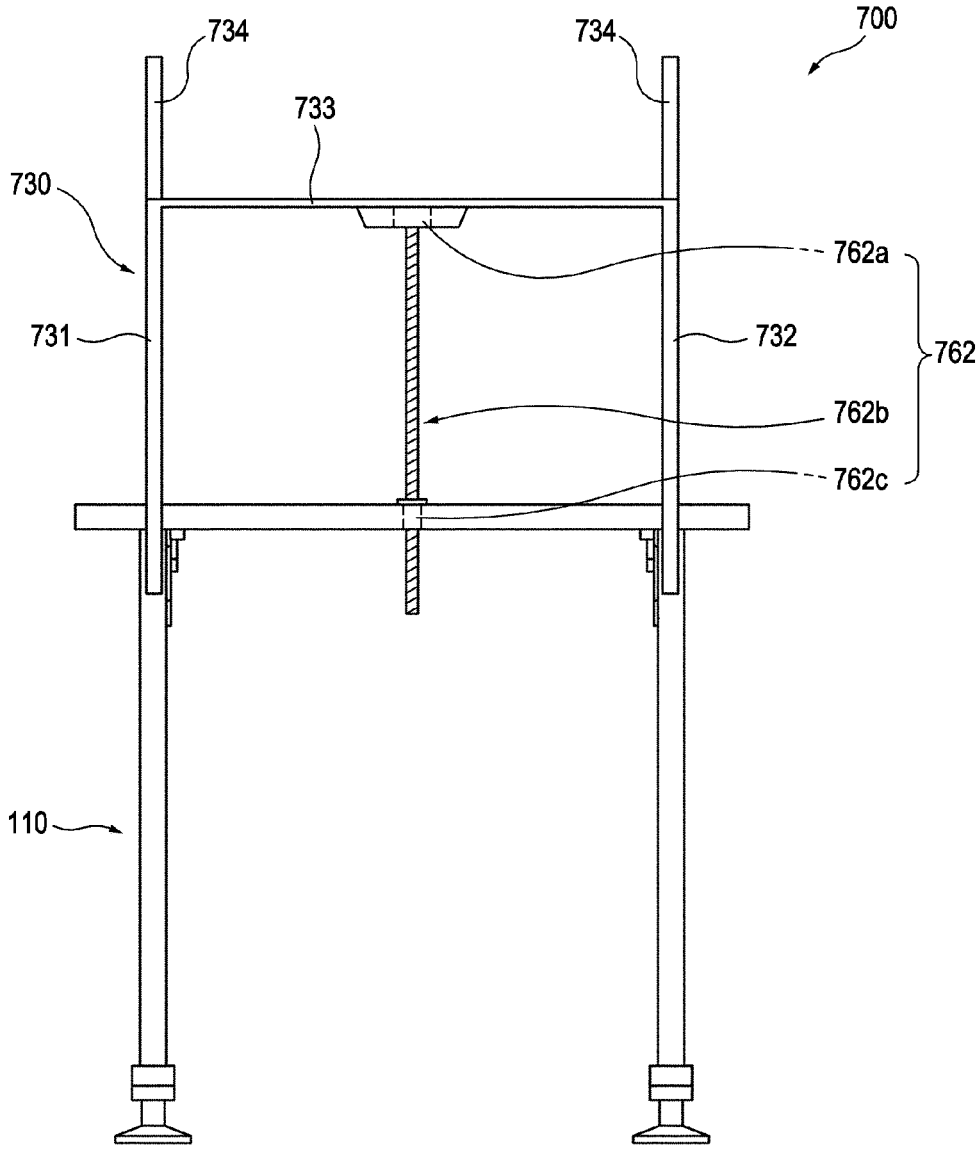
FIG. 19 is a rear view showing a desk according to yet another embodiment of the present invention.

Referring to FIGS. 18 and 19, a desk 700 according to a still further embodiment of the present invention includes the support legs 110, the upper panel 120, a support member 730, and a drive means 761, 762. The desk 700 of this embodiment has a configuration identical or similar to those of the desks 500 and 600 according to the embodiments shown in FIGS. 14 to 17, except for the configurations of the support member 730 and the drive means 761 and 762. Thus, the support member 730 and the drive means 761, 762 will be described in detail in this embodiment.

As shown in FIGS. 18 and 19, the support member 730 includes first and second guide members 731, 732, a horizontal bar 733 and connection members 734. The first and second guide members 731, 732 are inserted to the support legs 110 through the upper panel 120 to and are slidable upward or downward. To this end, each support leg 110 may include a shape of a hollow frame. The horizontal bar 733 is coupled between upper ends of the first and second guide members 731, 732. The connection members 734 are vertically coupled to both ends of the horizontal bar 733.

As shown in FIG. 18, the drive means 761 includes a plunger 761*a* coupled to a lower side of the horizontal bar 733 and a hydraulic or pneumatic actuator 761*b* coupled to a lower side of the desk 700. The hydraulic or pneumatic actuator 761*b* is coupled to a support panel 761*c* disposed between the support legs 110. Thus, the horizontal bar 733 and the connection members 734 are movable upward or downward by the operation of the hydraulic or pneumatic actuator 761*b*.

As shown in FIG. 19, the drive means 762 includes a drive motor 762*a* coupled to the underside of the horizontal bar 733, a screw shaft 762*b* coupled to a rotating shaft of the drive motor 762*a* and a nut member 762*c* coupled to the upper panel 120 and threadedly coupled to the screw shaft 762*b*. The horizontal bar 733 and the connection members 734 are movable upward and downward by the operation of the drive motor 762*a*.

Figure 20:
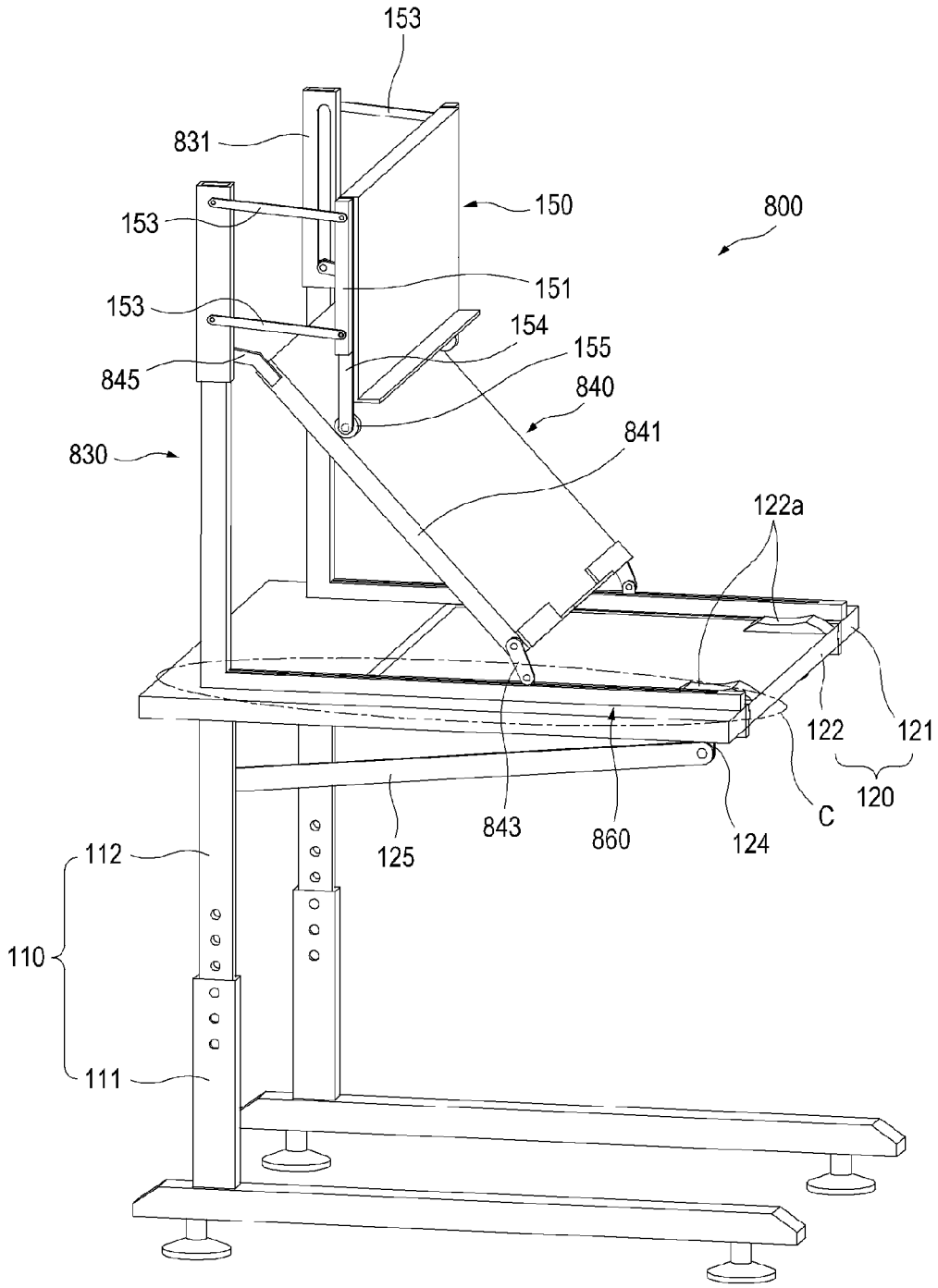
FIG. 20 is a perspective view showing a desk according to yet another embodiment of the present invention.
Figure 21:
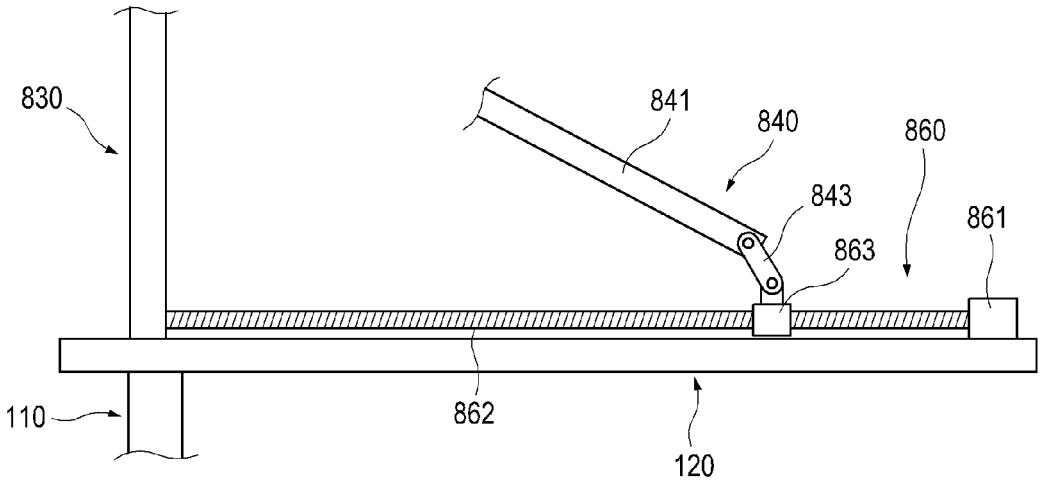
FIG. 21 is an enlarged perspective view of portion C of FIG. 20.

Referring to FIGS. 20 and 21, a desk 800 according to a still further embodiment of the present invention includes the support legs 110, the upper panel 120, support members 830, a movable panel 840, the vertical panel 150 and a drive means 860. The desk 800 of this embodiment has a configuration identical or similar to that of the desk 100 according to the embodiment shown in FIGS. 3 to 6, except for the configuration of the support members 830, the movable panel 840 and the drive means 860. Thus, the support members 830, the movable panel 840 and the drive means 860 will be described in detail in this embodiment.

As shown FIG. 20, the support members 830 are vertically coupled to rear both sides of the upper panel 120. A guide groove 831 is formed in an upper portion of each support member 830.

A lower end of a movable panel frame 841 is connected to the drive means 860 through a first arm 843. One end of the first arm 843 is fixedly or rotatably coupled to the lower end of the movable panel frame 841, while the opposite end thereof is hinge-coupled to a nut member 863. An upper end of the movable panel frame 841 is connected to the upper portion of the support member 830 through a second arm 845. One end of the second arm 845 is fixed to the upper end of the movable panel frame 841, while the opposite end of the second arm 845 slides upward or downward in the guide groove 831.

As shown in FIG. 21, the drive means 860 may include a drive motor 861, a screw shaft 862 and the nut member 863. The drive motor 861 is affixed to a front or rear side of the upper panel 120. The screw shaft 862 is coupled to a rotating shaft of the drive motor 861. The screw shaft 862 is disposed parallel to the upper panel 120. The nut member 863 is threadedly coupled to the screw shaft 862 and a plurality of balls are interposed between the screw shaft 862 and the nut member 863. Accordingly, as the drive motor 861 operates, the nut member 863 threadedly moves along the screw shaft 862. The drive means of the present invention is not limited to the drive motor and ball screw, but may include a hydraulic or pneumatic actuator, a belt and a pulley, rack and pinion gears or the like.

For example, if the drive motor 861 operates in one direction, then one end of the first arm 843 moves backward, while the opposite ends of the second arms 845 move toward upper ends of the guide grooves 831 along the guide grooves 831. In addition, the vertical panel 150 moves downward and backward along with the movable panel 840. As a result, the movable panel 840 and the vertical panel 150 are juxtaposed one above the other approximately vertical to the upper panel 120. If the drive motor 861 operates in an opposite direction to the above direction, then the one end of the first arm 843 moves forward, while the opposite ends of the second arms 845 moves toward lower ends of the guide grooves 831 along the guide grooves 831. In addition, the vertical panel 150 moves upward and forward along with the movable panel 840. As a result, the movable panel 840 and the vertical panel 150 go into the state shown in FIG. 20.

In a variant of the desk 800, the movable panel 140 may be configured such that the upper end thereof moves upward and downward along the support members by a drive means. To this end, the screw shaft of the drive means is disposed parallel to the support member 130 and the upper end of the movable panel frame 141 is hinge-coupled to a nut member.

Figure 22:
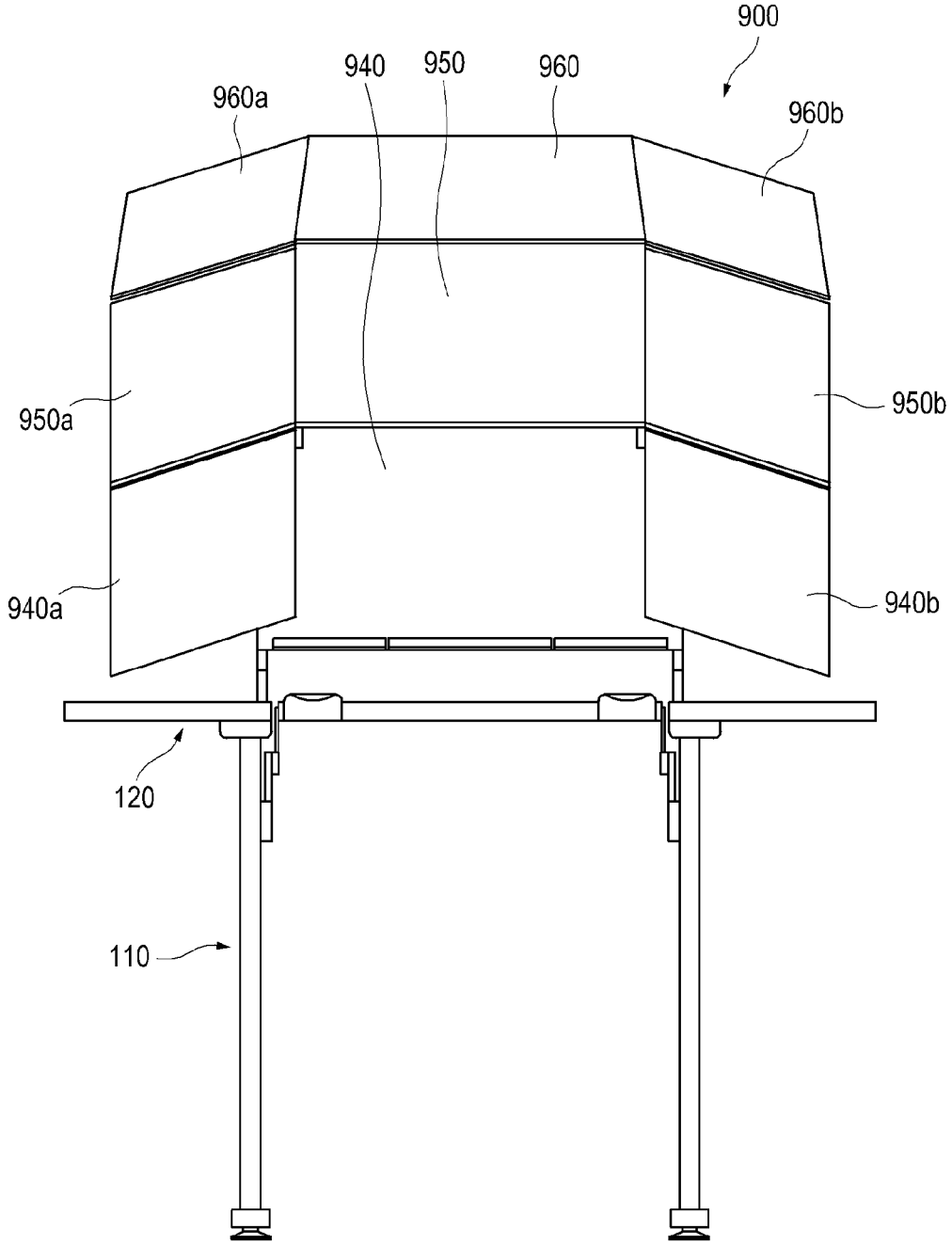
FIG. 22 is a front view showing a desk according to yet another embodiment of the present invention.

Referring to FIG. 22, a desk 900 according to a still further embodiment of the present invention includes the support legs 110, the upper panel 120, the support members 130, a movable panel 940, a vertical panel 950 and an expansion panel 960. The desk 900 of this embodiment has a configuration identical or similar to those of the desks 100, 200, 300, 400, 500, 600, 700, 800 according to the embodiments shown in FIGS. 3 to 21, except for the configurations of the movable panel 940, the vertical panel 950, and the expansion panel 960. Thus, the movable panel 940, the vertical panel 950 and the expansion panel 960 will be described in detail in this embodiment.

First auxiliary panels 940*a*, 940*b* may be provided at left and right sides of the movable panel 940 respectively. The first auxiliary panels 940*a*, 940*b* are rotatably coupled to the left and right sides of the movable panel 940 by means of a hinge or the like. That is, the first auxiliary panels 940*a*, 940*b* may be folded onto the movable panel 940 through rotation. Further, stoppers are foldably provided at lower ends of the first auxiliary panels 940*a*, 940*b*. Accordingly, after the stoppers of the first auxiliary panels 940*a*, 940*b* are folded first, the first auxiliary panels 940*a*, 940*b* should be folded onto the movable panel 940.

Second auxiliary panels 950*a*, 950*b* may be provided at left and right sides of the vertical panel 950. The second auxiliary panels 950*a*, 950*b* are rotatably coupled to the left and right sides of the vertical panel 950 by means of a hinge or the like. That is, the second auxiliary panels 950*a*, 950*b* may be folded onto the vertical panel 950 through rotation. Further, stoppers are foldably provided at lower ends of the second auxiliary panels 950*a*, 950*b*. After the stoppers of the second auxiliary panels 950*a*, 950*b* are folded first, the second auxiliary panels 950*a*, 950*b* should be folded onto the vertical panel 950.

The expansion panel 960 may be provided at an upper side of the 950 and third auxiliary panels 960*a*, 960*b* may be provided at left and right sides of the expansion panel 960. The expansion panel 960 is rotatably coupled to an upper end of the vertical panel 950 by means of a hinges and the like. That is, the expansion panel 960 may be folded onto the vertical panel 950 through rotation. The third auxiliary panels 960*a*, 960*b* are rotatably coupled to the left and right sides of the expansion panel 960 by means of a hinge or the like. That is, the third auxiliary panels 960*a* and 960*b* may be folded onto the expansion panel 960 through rotation. Further, stoppers are foldably provided at lower ends of the expansion panel 960 and the third auxiliary panels 960*a*, 960*b*. After the stoppers of the third auxiliary panels 960*a*, 960*b* are folded first, the third auxiliary panels 960*a*, 960*b* should be folded onto the expansion panel 960. Further, after the second auxiliary panels 950*a*, 950*b* are folded onto the vertical panel 950, the expansion panel 960 onto which the third auxiliary panels 960*a*, 960*b* are folded should be folded onto the vertical panel 950.

Figure 23:
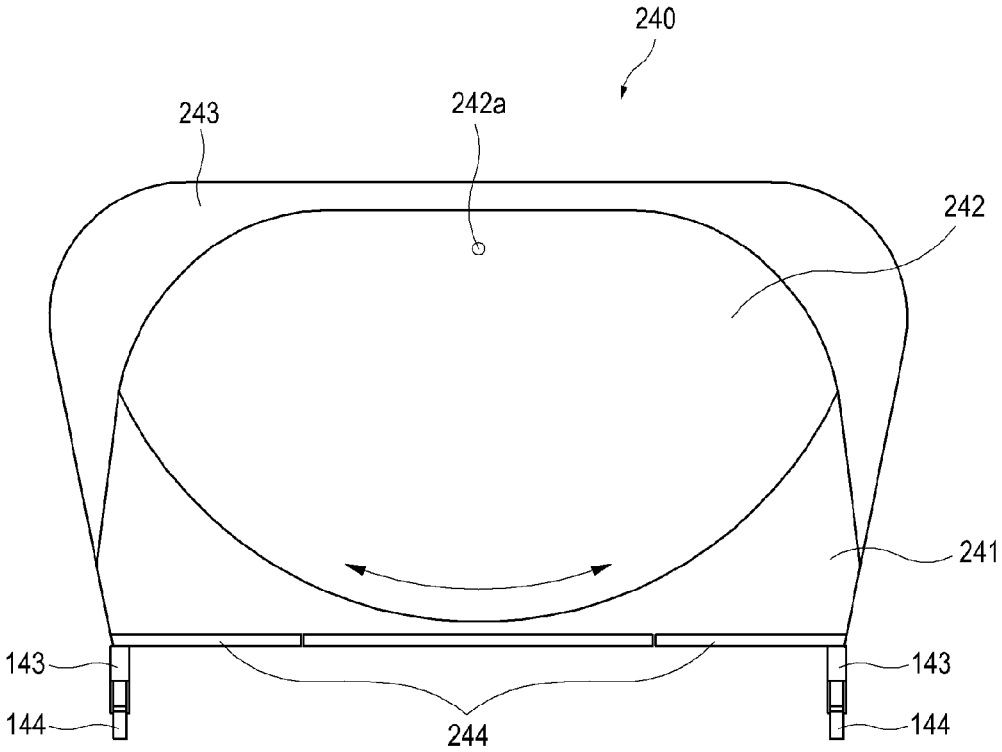
FIG. 23 is a front view showing a movable panel according to one embodiment of the present invention.

Referring to FIG. 23, a movable panel 240 according to one embodiment of the present invention includes a support panel, a fixed panel 241, a rotational panel 242, a cover 243 and stoppers 244. The fixed panel 241 is coupled to the support panel. A plurality of stoppers 244 may be foldably provided at a lower end of the fixed panel 241. The rotational panel 242 is located at the upper side of the fixed panel 241 and is rotated around a rotation shaft 242*a* joined to the support panel. The rotation shaft 242*a* is disposed on the upper side of the rotational panel 242 and thus the rotational panel 242 always maintains the state shown in FIG. 23 due to its own weight. Thus, even if the rotational panel 242 is rotated in one direction, the rotational panel 242 returns to its original position through its rotation around the rotation shaft 242*a* after use. The cover 243 prevents a side portion of the rotational panel 242 from appearing when the rotational panel 242 rotates. Further, the movable panel 240 may include the first arms 143 and the first rollers 144 of the embodiment shown in FIGS. 3 to 6. With the above-described configuration, when the user places a notebook on the movable panel 240 and takes notes, the user rotates the rotational panel 242 without moving his/her upper body and can easily take notes.

Figure 24:
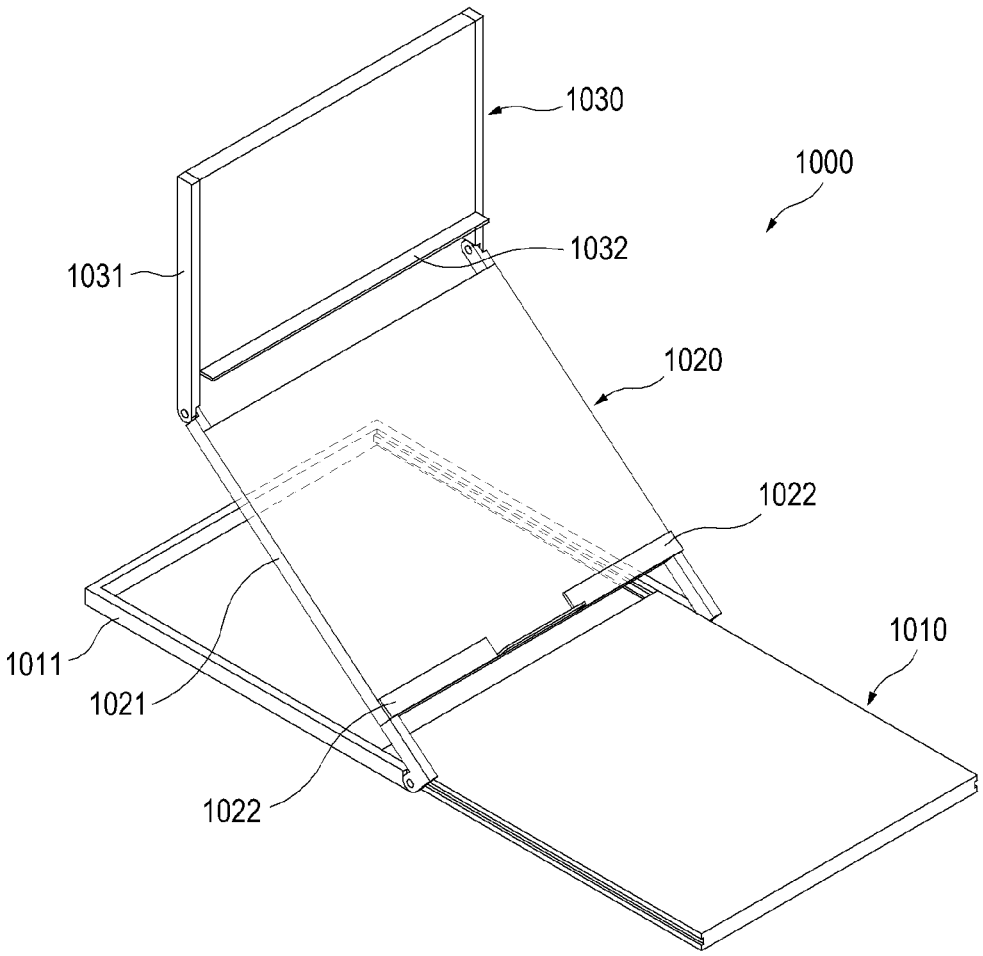
FIG. 24 is a perspective view showing a desk according to a further embodiment of the present invention.

Referring to FIG. 24, a desk 1000 according to one embodiment of the present invention includes a horizontal panel 1010, a first slant panel 1020 and a second slant panel 1030. The desk 1000 may be used portably.

The horizontal panel 1010 serves as an upper panel of a desk. A horizontal panel frame 1011 is coupled to left and right sides of the horizontal panel 1010 in the rear thereof. The horizontal panel frame 1011 serves to support the first slant panel 1020. Further, the horizontal panel 1010 may be coupled to the horizontal panel frame 1011 to slide with respect to the horizontal panel frame 1011.

The first slant panel 1020 is configured such that its slant angle can be adjusted with respect to the horizontal panel 1010. First slant panel frames 1021 are coupled to both sides of the first slant panel 1020. A lower end of each first slant panel frame 1021 is rotatably coupled to a front end of the horizontal panel frame 1011. A first stopper 1022 is foldably provided at a lower end of the first slant panel 1020.

The second slant panel 1030 is configured such that its slant angle can be adjusted with respect to the first slant panel 1020.

Second slant panel frames 1031 are coupled to both sides of the second slant panel 1030. A lower end of each second slant panel frame 1031 is rotatably coupled to an upper end of the first slant panel frame 1021. A second stopper 1032 is foldably provided at a lower end of the second slant panel 1030.

The rotation coupling configuration between the support arm 125 and the support leg 110 of the embodiment shown in FIGS. 3 to 6 may be applied to the coupling configuration between the lower end of the first slant panel frame 1021 and the front end of the horizontal panel frame 1011 and the coupling configuration between the lower end of the second slant panel frame 1031 and the upper end of the first slant panel frame 1021.

In the desk 1000 of this embodiment, if the first slant panel 1020 rotates downward with respect to the horizontal panel 1010 and the second slant panel 1030 rotates downward with respect to the first slant panel 1020, then the horizontal panel 1010, the first slant panel 1020 and the second slant panel 1030 are superimposed one above the other. Thus, the user can easily carry and transport the desk 1000. Further, the user can use the desk 1000 in any place by rotating the second slant panel 1030 upward with respect to the first slant panel 1020 and rotating the first slant panel 1020 upward with respect to the horizontal panel 1010.

Figure 25:
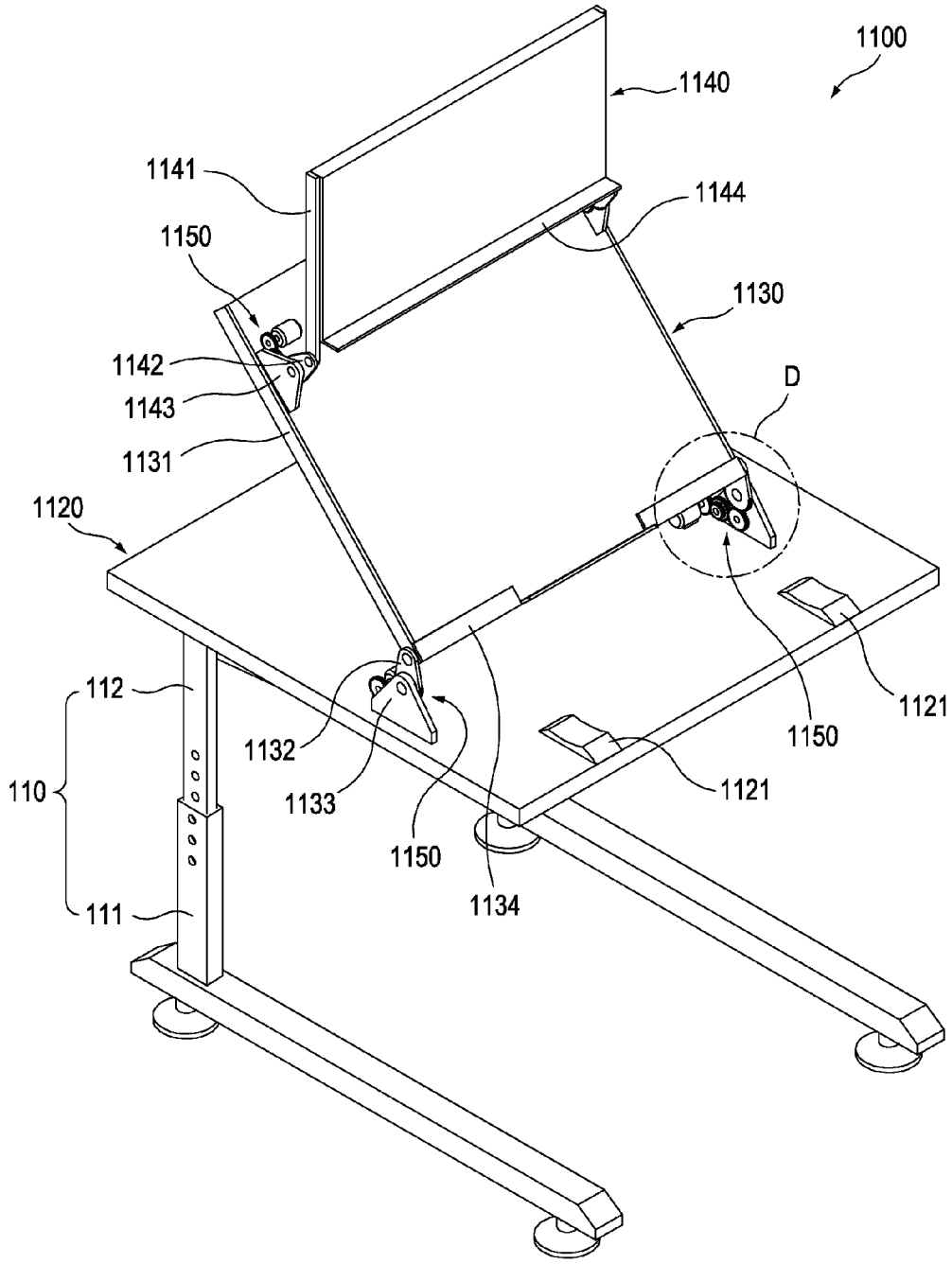
FIG. 25 is a perspective view showing a desk according to a further embodiment of the present invention.
Figure 26:
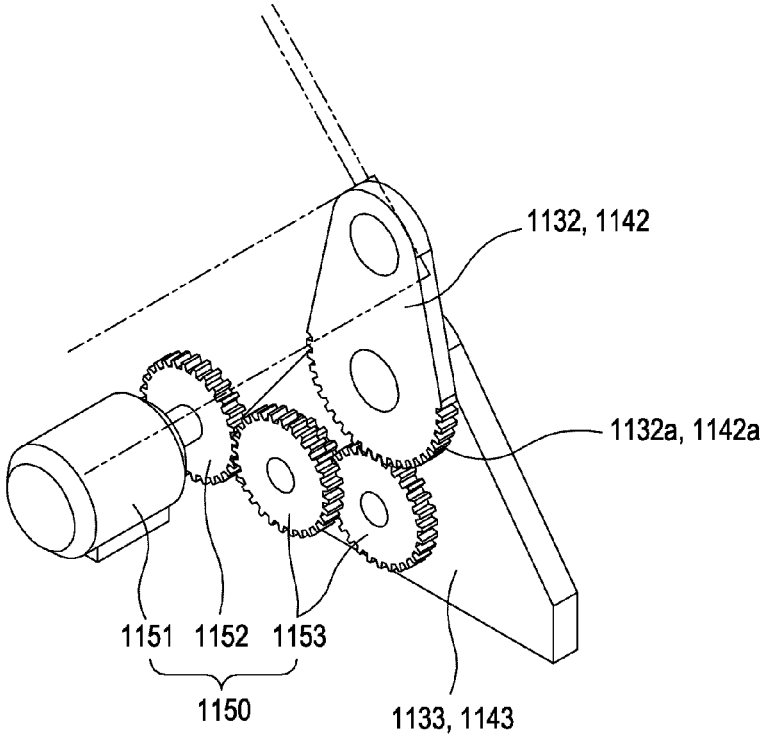
FIG. 26 is an enlarged view of portion D of FIG. 25.

Referring to FIGS. 25 and 26, a desk 1100 according to one embodiment of the present invention includes the support legs 110, an upper panel 1120, first and second slant panels 1130 and 1140 and a drive means 1150.

The upper panel 1120 is coupled to upper sides of the support legs 110 to support the first slant panel 1130. A cushion member 1121 may be provided at a front side of the upper panel 1120.

The first slant panel 1130 is configured such that its slant angle can be adjusted with respect to the upper panel 1120. First slant panel frames 1131 are coupled to both sides of the first slant panel 1130. A first arm 1132 is coupled to a lower end of each first slant panel frame 1131. The first arm 1132 is rotatably coupled to a first bracket 1133 affixed to the upper panel 1120. First stoppers 1134 are foldably provided at a lower end of the first slant panel 1130.

The second slant panel 1140 is configured such that its slant angle can be adjusted with respect to the first slant panel 1130. Second slant panel frames 1141 are coupled to both sides of the second slant panel 1140. A second arm 1142 is coupled to a lower end of each second slant panel frame 1141. The second arm 1142 is rotatably coupled to a second bracket 1143 fixed to the first slant panel 1130. A second stopper 1144 is foldably provided at a lower end of the second slant panel 1140.

Gear teeth 1132*a* and 1142*a* are formed on ends of the first and second arms 1132, 1142. The drive means 1150 are disposed between the first arm 1132 and the first bracket 1133 and between the second arm 1142 and the second bracket 1143. The rotational coupling configuration between the support arm 125 and the support leg 110 of the embodiment shown in FIGS. 3 to 6 may be applied between the first arm and the first bracket and between the second arm and the second bracket.

Referring to FIG. 26, the drive means 1150 includes a drive motor 1151, a drive gear 1152 and a gear train 1153. The drive motor 1151 is fixed to the upper panel 1120 or the first slant panel 1130. The drive gear 1152 is coupled to a rotating shaft of the drive motor 1151. The gear train 1153 is interposed between the drive gear 1152 and the gear teeth 1132*a*, 1142*a* and serves to reduce the rotation speed of the drive gear 1152. Thus, the slant angle of the first slant panel 1130 with respect to the upper panel 1120 and the slant angle of the second slant panel 1140 with respect to the first slant panel 1130 can be adjusted in an electric-powered manner by means of the operation of the drive motor 1151.

Figure 27:
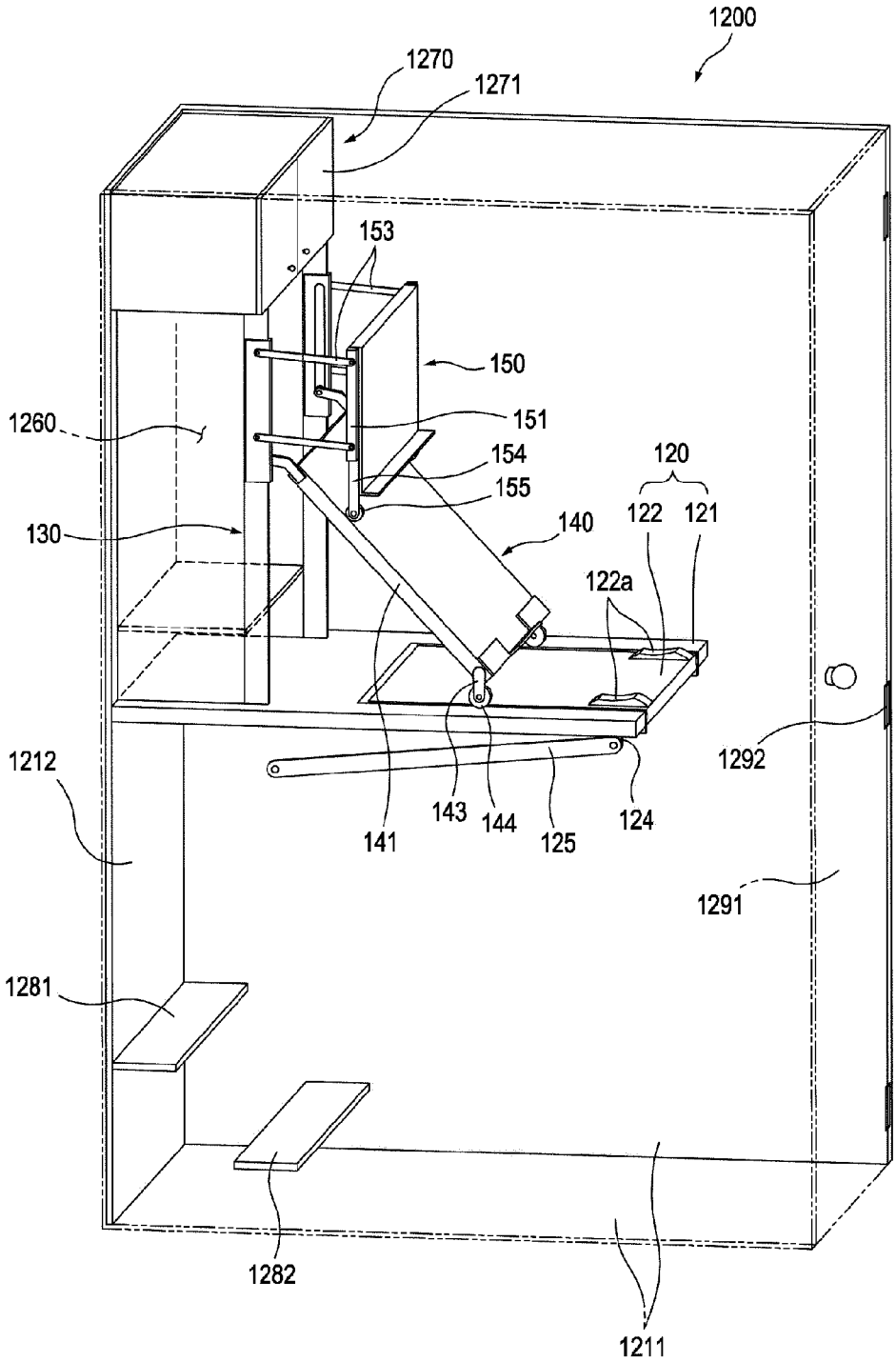
FIG. 27 is a perspective view showing a desk according to a further embodiment of the present invention.

Referring to FIG. 27, a desk 1200 according to one embodiment of the present invention includes side partition panels 1211, a back partition panel 1212, the upper panel 120, the support members 130, the movable panel 140, the vertical panel 150, a bookshelf 1260, a closet 1270, footrests 1281, 1282 and a front door 1291. The desk 1200 may be used as a desk for a reading room. The upper panel 120, the support members 130, the movable panel 140 and the vertical panel 150 of the embodiment shown in FIGS. 3 to 6 may be applied to the desk 1200 of this embodiment. Further, the upper panel, the support members, the movable panel and the vertical panel of this embodiment may be variously modified and implemented according to the embodiments shown in FIGS. 7 to 23. Accordingly, the side partition panels 1211, the back partition panel 1212, the bookshelf 1260, the closet 1270 and the footrests 1281, 1282 will be described in detail in this embodiment.

The side partition panels 1211 serve as a support leg as well as a partition. The side partition panels 1211 are vertically disposed at left and right sides of the upper panel 120, while the back partition panel 1212 is vertically disposed at the rear of the upper panel 120.

The bookshelf 1260 is disposed between the support members 130 and the back partition panel 1212. As described above, the user can use the bookshelf 1260 after rotating the movable panel 140 with respect to the movable panel frames 141 or rotating the vertical panel 150 with respect to the vertical panel frames 151.

Further, the closet 1270 may be disposed on an upper end of the bookshelf 1260. The closet 1270 may include an openable door 1271. The door 1271 may include various types of locking means.

A plurality of the footrests 1281, 1282 may be provided between the side partition panels 1211 (i.e., below the upper panel 120). The plurality of the footrests 1281, 1282 may be provided at different heights. Accordingly, the user can rest his/her foot on the footrest located at an appropriate height according to his/her body shape or posture.

The front door 1291 is openably coupled to a front end of the side partition panel 1211 by hinges. Accordingly, the user can open the front door 1291 to access the desk, and the user can use the desk after closing the front door 1291. Thus, an individual space can be supplied to the user.

Figure 28:
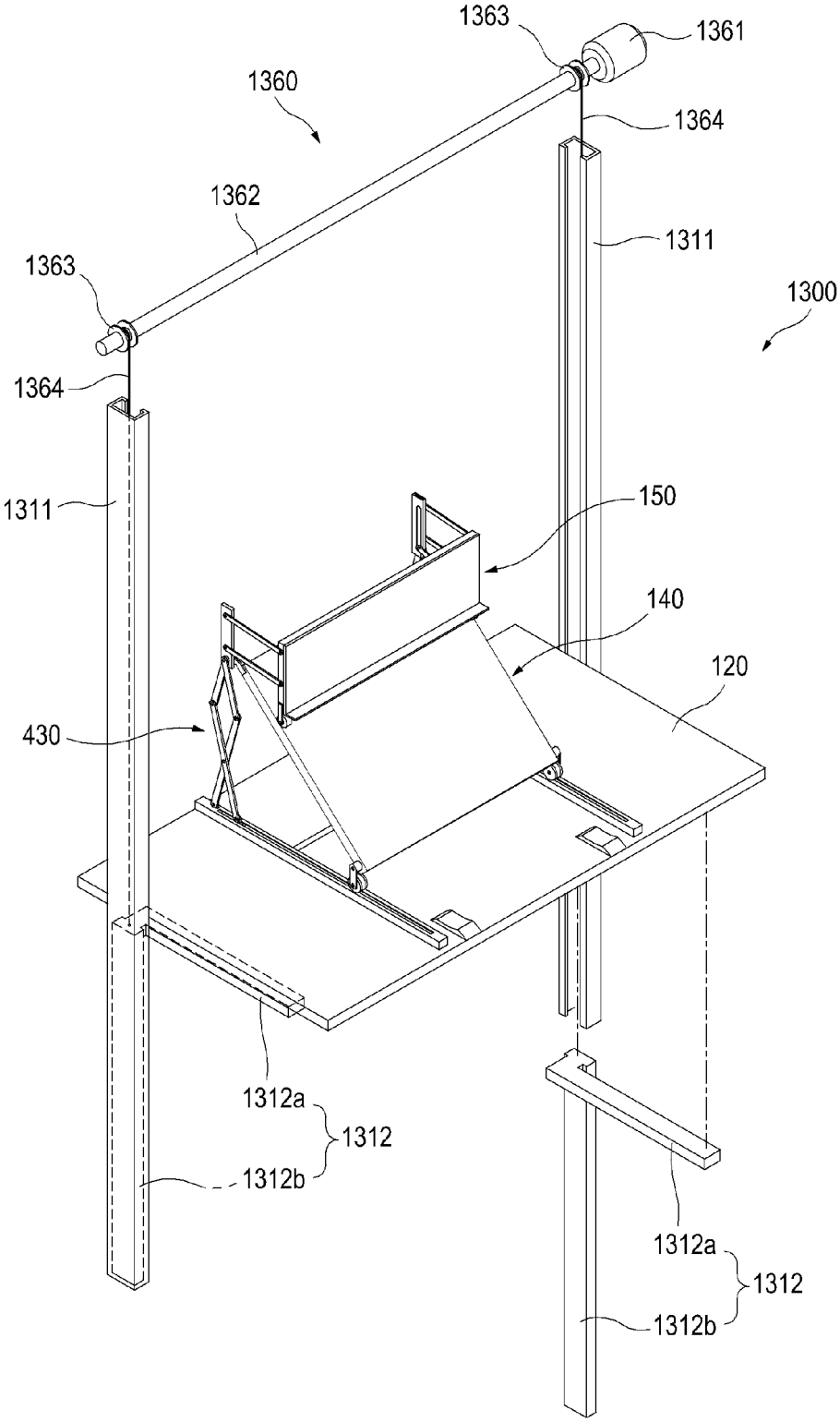
FIG. 28 is a perspective view showing a desk according to a further embodiment of the present invention.

Referring to FIG. 28, a desk 1300 according to one embodiment of the present invention includes guide members 1311, support legs 1312, the upper panel 120, the support members 430, the movable panel 140, the vertical panel 150, the drive means 460 and a second drive means 1360. The upper panel 120, the support members 430, 530, the movable panel 140, the vertical panel 150 and the drive means 460 of the embodiments shown in FIGS. 11 to 15 may be applied to the desk 1300 of this embodiment. Thus, the guide members 1311, the support legs 1312 and the second drive means 1360 will be described in detail in this embodiment.

As shown in FIG. 28, the guide members 1311 are provided vertically to the ground. The guide members 1311 have a hollow shape so that the support legs 1312 may be inserted into the guide members 1311, respectively. Further, each guide member 1311 is formed with a guide groove along the lengthwise direction of the guide member 1311. Each support leg 1312 has an L-shape and may include a horizontal portion 1312*a* and a vertical portion 1312*b*. The horizontal portion 1312*a* is coupled to an underside of the upper panel 120, while the vertical portion 1313*b* is inserted into the guide member 1311 and slides upward and downward.

The second drive means 1360 includes a drive motor 1361, a drive shaft 1362, reels 1363, and wires 1364. The drive motor 1361 is affixed to a wall or ceiling of a building. The drive shaft 1362 is coupled to a rotating shaft of the drive motor 1361. The reels 1363 around which the wires 1364 are wound are disposed at both ends of the drive shaft 1362. One end of each wire 1364 is coupled to the upper panel 120 or the support leg 1312, while the opposite end thereof is coupled to the reel 1363.

In the state shown in FIG. 28, if the drive motor 1361 operates in one direction, then the wires 1364 are wound around the reels 1363. Thus, the vertical portions 1313*b* of the support legs 1312 move upward along the guide members 1311. As a result, the desk 1300 moves upward. On the contrary, as the drive motor 1361 operates in an opposite direction to the above direction, the wires 1364 are unwound from the reels 1363. Thus, due to the weight of the desk 1300, the vertical portions 1313*b* of the support legs 1312 move downward along the guide member 1311. As a result, the desk 1300 moves downward.

As the desk 1300 moves upward or downward, the movable panel 140 and the vertical panel 150 may be juxtaposed one above the other or be spread. In this regard, a limit switch may be further provided in an approximately halfway portion of the guide member 1311. For example, if the upper panel 120 moves upward to come into contact with the limit switch, then the drive means 460 is operated so as to vertically juxtapose the movable panel 140 and the vertical panel 150 one above the other as shown in FIG. 13. Further, if the upper panel 120 moves downward to come into contact with the limit switch, then the drive means 460 is operated so as to spread the movable panel 140 and the vertical panel 150 as shown in FIG. 28.

Figure 29:
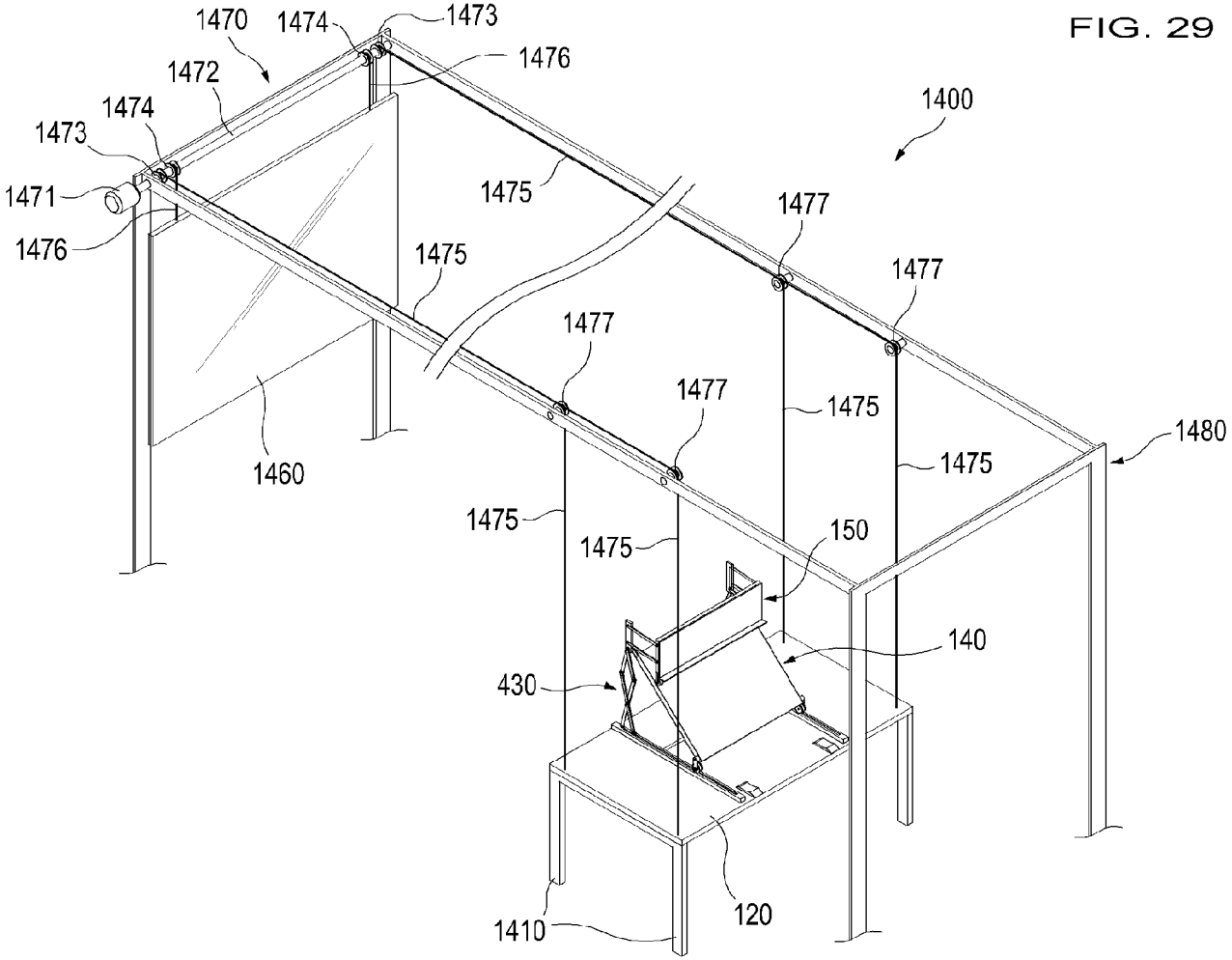
FIG. 29 is a perspective view showing a desk according to a further embodiment of the present invention.

Referring to FIG. 29, a desk 1400 according to a still further embodiment of the present invention includes support legs 1410, the upper panel 120, the support members 430, the movable panel 140, the vertical panel 150, the drive means 460, an image display device 1460 and a second drive means 1470. The upper panel 120, the support members 430, 530, the movable panel 140, the vertical panel 150 and the drive means 460 of the embodiments shown in FIGS. 11 to 15 may be applied to the desk 1400 of this embodiment. Thus, the support legs 1410, the image display device 1460 and the second drive means 1470 will be described in detail in this embodiment.

The support legs 1410 are rotatably coupled to the underside of the upper panel 120. The support legs 1410 may rotate by a third drive means in an electric-powered manner. The image display device 1460 may comprise a screen-type or thin-film-type television and can be utilized for TV watch, a video conference or the like. The image display device 1460 may function as a large-sized monitor for a computer. Further, the image display device 1460 is movable upward and downward by the second drive means 1470.

The second drive means 1470 includes a drive motor 1471, a drive shaft 1472, first and second reels 1473, 1474, first and second wires 1475, 1476 and a plurality of guide pulleys 1477. The drive motor 1471 is affixed to a wall or ceiling of a building. The drive shaft 1472 is coupled to a rotating shaft of the drive motor 1471. The first reels 1473 are disposed at both ends of the drive shaft 1472, while the second reels 1474 are disposed inside of the first reels 1473. A diameter ratio of the first reel 1473 to the second reel 1474 is appropriately determined depending upon the vertical movement distance of the image display device 1460 and the upper panel 120. The first wires 1475 and the second wires 1476 are wound around the first reels 1473 and the second reels 1474, respectively. One end of each first wire 1475 is coupled to the upper panel 120 or the support leg 1410, while the opposite end thereof is coupled to the first reel 1473. The guide pulleys 1477 are affixed to the wall or ceiling of the building. The guide pulleys 1477 serve to divert the moving direction of the first wires 1475 and guide the first wire 1475. One end of each second wire 1476 is coupled to the image display device 1460, while the opposite end thereof is coupled to the second reel 1474. As shown in FIG. 29, the drive motor 1471, the drive shaft 1472, and the guide pulleys 1477 may be mounted to a frame 1480 which is additionally provided.

In a state shown in FIG. 29, if the drive motor 1471 operates in one direction, then the first wires 1475 are wound around the reels 1363, while the second wires 1476 are unwound from the second reels 1474. Thus, the desk 1400 moves upward, while the image display device 1460 moves downward. On the contrary, as the drive motor 1471 operates in an opposite direction to the above direction, the first wires 1475 are unwound from the first reels 1473, while the second wires 1476 are wound around the second reels 1474. Thus, the desk 1400 moves downward, while the image display device 1460 moves upward.

As the upper panel 120 moves upward or downward, the support legs 1410, the movable panel 140 and the vertical panel 150 may be juxtaposed or be spread. In this regard, a limit switch may be provided at the wall of the building or the frame 1480. Further, a contact piece which comes into contact with the limit switches may be further provided at an approximately halfway portion of a horizontal section of the first wire 1475. For example, if the contact piece comes into contact with the limit switch during the upward movement of the upper panel 120, then the drive means 460 is operated so as to vertically juxtapose the movable panel 140 and the vertical panel 150. Simultaneously, the third drive means is operated so as to dispose the support legs 1410 under the underside of the upper panel 120. Further, if the contact piece comes into contact with the limit switch during the downward movement of the upper panel 120, then the drive means 460 is operated so as to spread the movable panel 140 and the vertical panel 150. Simultaneously, the third drive means is operated so as to spread the support legs 1410 from the upper panel 120.

Figure 30:
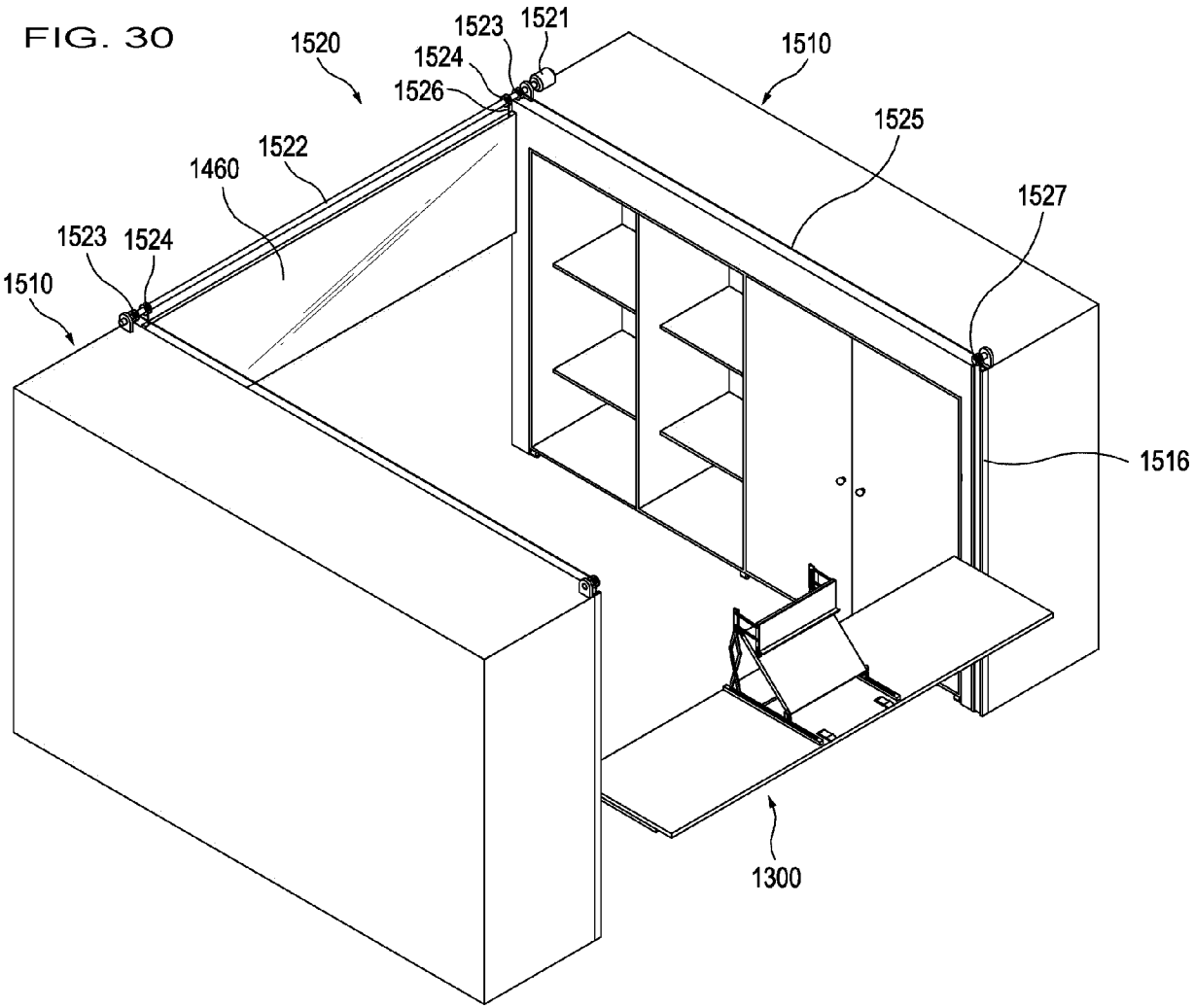
FIG. 30 is a perspective view showing a system furniture according to one embodiment of the present invention.

Referring to FIG. 30, a system furniture 1500 according to one embodiment of the present invention includes the desk 1300, the image display device 1460, closets 1510, and a drive means 1520. The desk 1300, 1400 of the embodiments shown in FIGS. 28 and 29 and the image display device 1460 of the embodiment shown in FIG. 29 may be applied to the system furniture 1500 of this embodiment. Thus, the closets 1510 and the drive means 1520 will be described in detail in this embodiment.

Figure 31:
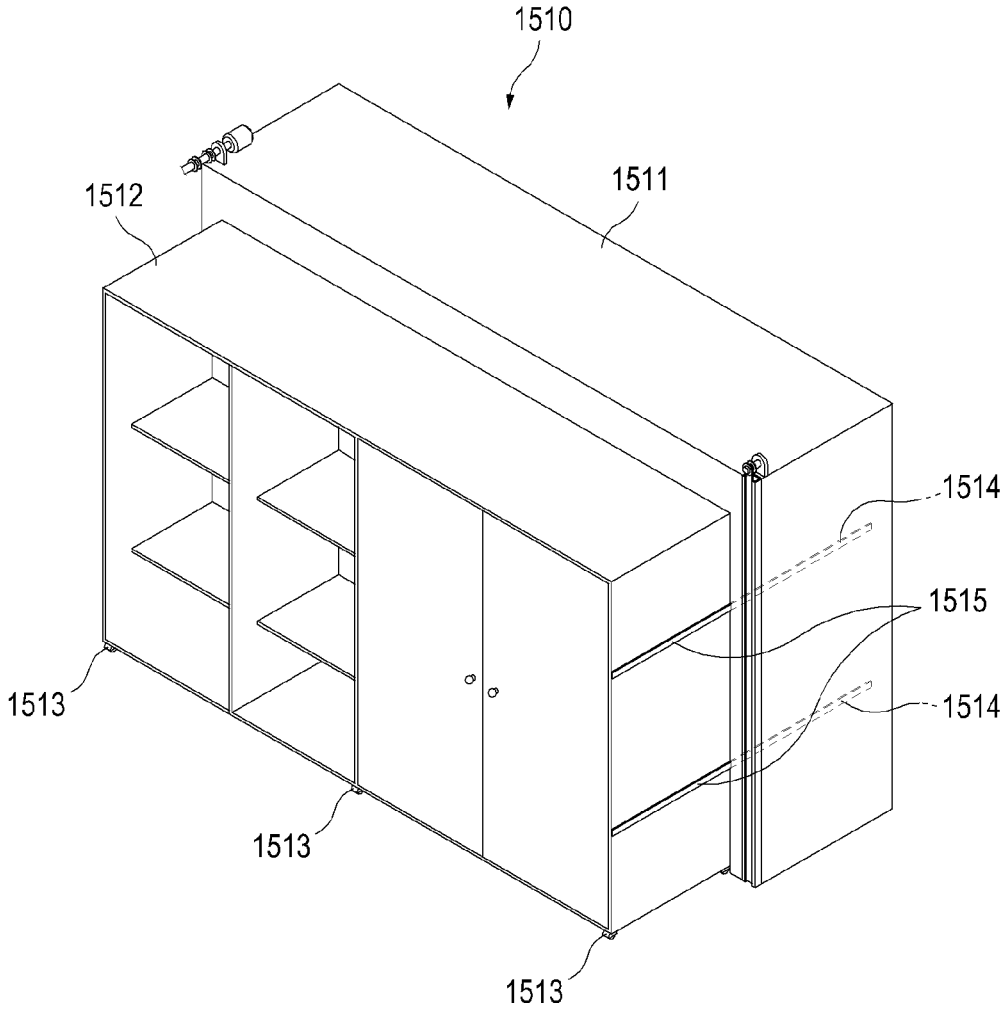
FIG. 31 is a perspective view showing an exemplary use of a closet of FIG. 30.

As shown in FIG. 31, each closet 1510 includes a fixed closet 1511, a movable closet 1512, rollers 1513, guide members 1514 and sliding members 1515. The fixed closet 1511 is fixed to the ground. The movable closet 1512 is configured to be drawn into or out of the affixed closet 1511. To this end, a plurality of the rollers 1513 are mounted on an underside of the movable closet 1512. Further, a plurality rows of the guide members 1514 are mounted to the inside of the fixed closet 1511 and a plurality rows of sliding members 1515 corresponding to the guide members 1514 respectively are mounted to both sides of the movable closet 1512. Thus, when the movable closet 1512 is drawn in or out, the guide members 1514 guide the sliding members 1515. When the movable closet 1512 is drawn out of the fixed closet 1511, the user can utilize an interior space of the fixed closet 1511. The closet 1510 may include a bookshelf, a clothes chest, drawers or a combination thereof.

In this embodiment, instead of the guide members 1311 of the desk 1300, first guide grooves 1516 for guiding both sides of the desk 1300 may be vertically formed at front sides of the fixed closets 1511. Further, second guide grooves for guiding both sides of the image display device 1460 may be formed at rear sides of the fixed closets 1511.

As shown in FIG. 30, the drive means 1520 includes a drive motor 1521, a drive shaft 1522, first and second reels 1523, 1524, first and second wires 1525, 1526 and guide pulleys 1527. The drive motor 1521 is affixed to a topside of the closet 1510. The drive shaft 1522 is coupled to a rotating shaft of the drive motor 1521. The first reels 1523 are disposed at both ends of the drive shaft 1522 and the second reels 1524 are disposed inside the first reels 1523. A diameter ratio of the first reel 1523 to the second reel 1524 is appropriately determined depending upon the vertical movement distance of the image display device 1460 and the upper panel 120. One end of each first wire 1525 is coupled to the upper panel 120, while the opposite end is coupled to the first reel 1523. One end of each second wire 1526 is coupled to the image display device 1460, while the opposite end is coupled to the second reel 1524. This embodiment may be configured such that the first wires 1525 are wound around the first reels 1523, while the second wires 1526 wound around the second reels 1524 are unwound therefrom. That is, the winding directions of the first and second wires 1525 and 1526 may be opposite to one another. Accordingly, while the second wires 1526 are wound around the second reels 1524, the first wires 1525 wound around the first reels 1523 are unwound therefrom.

If the drive motor 1521 operates in one direction, then the upper panel 120 moves upward, while the image display device 1460 moves downward. Further, if the drive motor 1521 operates in an opposite direction to the above direction, the upper panel 120 moves downward, while the image display device 1460 moves upward.

Figure 32:
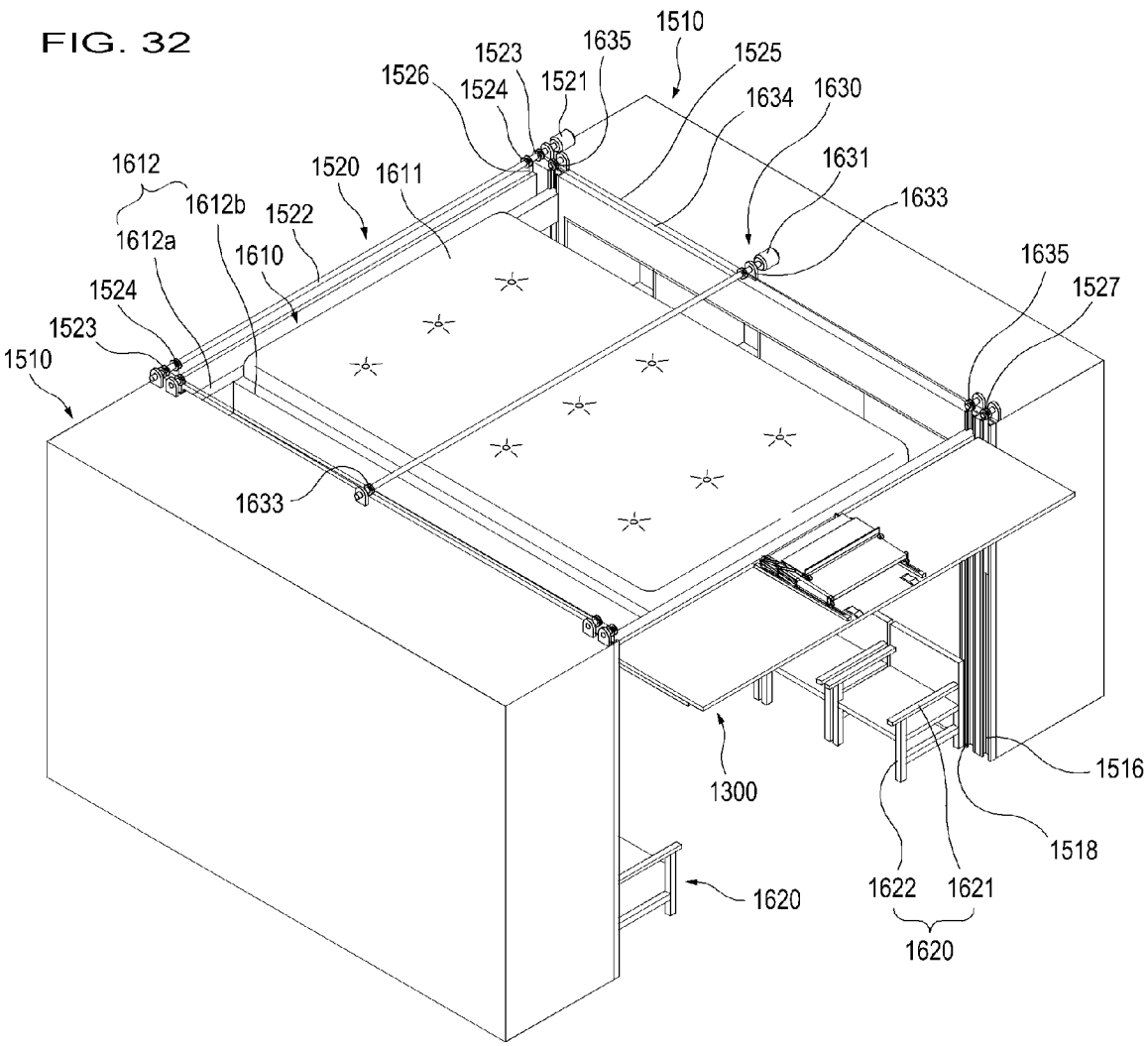
FIG. 32 is a perspective view showing a system furniture according to another embodiment of the present invention.
Figure 33:
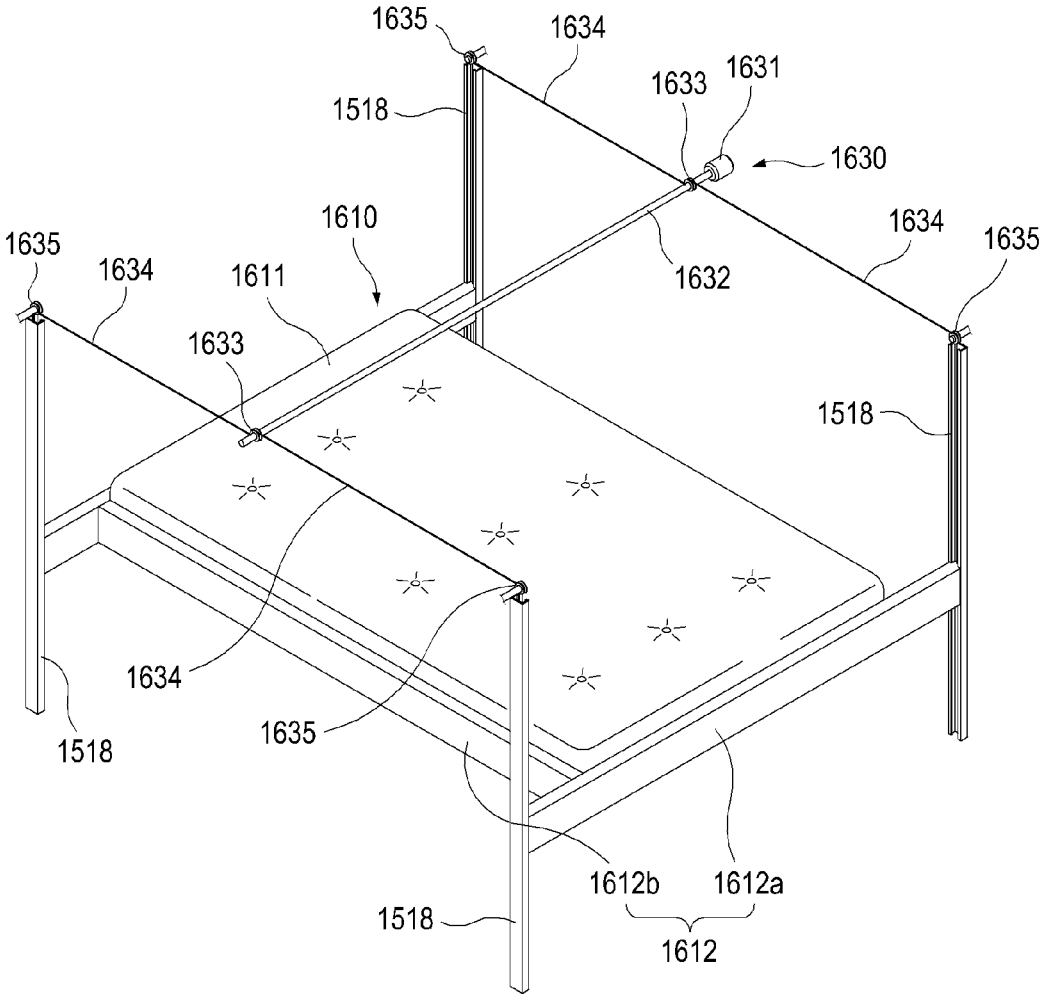
FIG. 33 is a schematic view showing a drive means shown in FIG. 32.

Referring to FIGS. 32 and 33, a system furniture 1600 according to another embodiment of the present invention includes a bed 1610, sofas 1620 and a drive means 1630 in addition to the system furniture 1500 of the embodiment shown in FIGS. 30 and 31.

Figure 34:
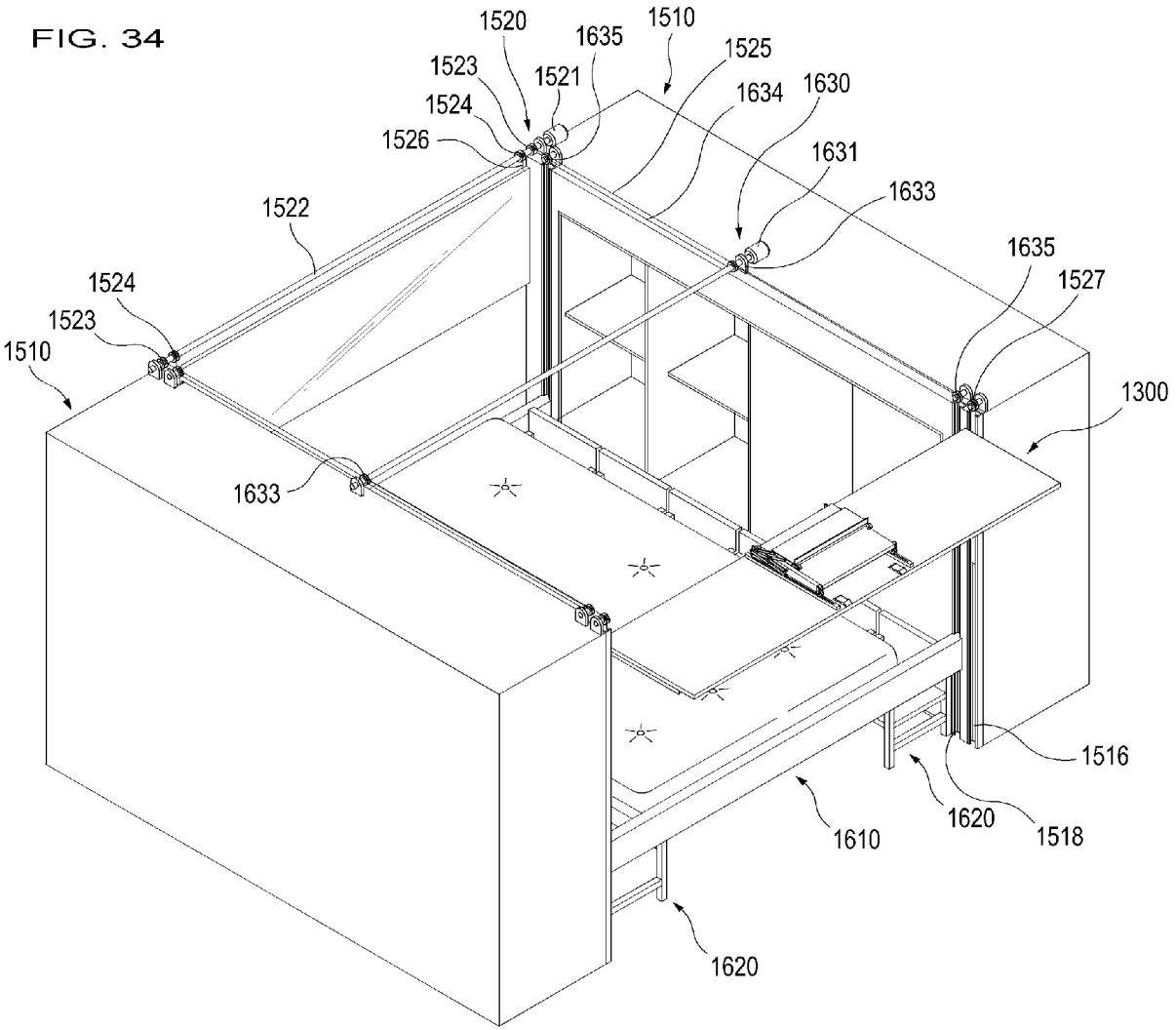
FIG. 34 is a perspective view showing an exemplary use of the system furniture shown in FIG. 32.

Referring to FIGS. 32 to 34, the bed 1610 includes a mattress 1611 and a bed frame 1612. In this embodiment, variously shaped and sized mattresses 1611 may be used. The bed frame 1612 may have various forms and sizes depending upon the size of the mattress 1611. The bed frame 1612 is disposed on sides and a bottom of the mattress 1611 to thus support the mattress 1611. Further, the bed frame 1612 is movable upward and downward with respect to the closets 1510 located with the bed frame 1612 therebetween. To this end, the bed frame 1612 includes guide frames 1612*a* disposed at front and rear sides of the mattress 1611 and support frame 1612*b* disposed at both sides of the mattress 1611. Further, third guide grooves 1518 are formed at a rear side of the first guide groove 1516 and at a rear side of the closet 1510. That is, both ends of the guide frame 1612*a* are inserted to the third guide grooves 1518 and move upward and downward along the third guide grooves 1518.

As shown in FIG. 32, a plurality of the sofas 1620 may be provided between the closets 1510. The sofas 1620 are used for rest or the reception of a guest at normal times. Each sofa 1620 includes armrests 1621, support legs 1622 and rollers 1623. The armrests 1621 are supported by the support legs 1622. The rollers 1623 are coupled to lower ends of the support legs 1622 and thus the sofa 1620 is movable to any place. For example, to draw out the closet 1510, the sofa 1620 may be moved to another position. When the bed 1610 is lowered down as shown in FIG. 34, a lower end of the bed frame 1612 is placed on upper ends of the armrests 1621 of the sofas 1620. Therefore, the sofas 1620 serve to firmly support the bed 1610.

The drive means 1630 serves to lift and lower the bed 1610 in an electric-powered manner. As shown in FIG. 33, the drive means 1630 includes a drive motor 1631, a drive shaft 1632, reels 1633, a plurality of wires 1634 and guide pulleys 1635. The drive motor 1631 is affixed to a topside of the fixed closet 1511 of the closet 1510. The drive shaft 1632 is coupled to a rotating shaft of the drive motor 1631. The reels 1633, around which the plurality of wires 1634 may be wound, are disposed at both ends of the drive shaft 1632. One end of each wire 1634 is coupled to each of both ends of the guide frame 1612*a* of the bed 1610. The opposite end of the wire 1634 is coupled to the reel 1633 such that a plurality of the wires 1634 may be wound and unwound together along with the operation of the drive motor 1631. Each guide pulley 1635 is affixed to the topside of the fixed closet 1511 of the closet 1510 and diverts the moving direction of the wire 1634 and guides the wire. Further, the drive means 1630 further includes a second wire and a counterweight. One end of the second wire is coupled to the reel 1633, while the opposite end is coupled to the counterweight. The counterweight may be configured to move upward and downward in the fixed closet. By using the counterweight, the capacity of the drive motor 1631 can be reduced.

In the state shown in FIG. 32, if the drive motor 1631 operates in one direction, then the wires 1634 are unwound from the reels 1633. Thus, both ends of the guide frame 1612*a* move downward along the third guide grooves 1518, while the counterweight moves upward. As a result, as shown in FIG. 34, the bed 1610 is placed on the armrests 1621 of the sofas 1620. In this state, the user can use the bed 1610. Further, in the state shown in FIG. 34, if the drive motor 1631 operates in an opposite direction to the above direction, the wires 1634 are wound around the reels 1633. Thus, both ends of the guide frame 1612*a* move upward along the third guide grooves 1518, while the counterweight moves downward. As a result, as shown in FIG. 32, the 1610 moves upward. In this state, the user can use the desk 1300, the closets 1510, the sofas 1620 and the image display device 1460. The system furniture 1600 of this embodiment can provide efficient utilization of a narrow interior space.

In the foregoing embodiments, the upper panel, the movable panel, the vertical panel, the expansion panel, the first auxiliary panels, the second auxiliary panels, the third auxiliary panels may be made from an aluminum honey-comb board. The honey-comb board is manufactured by interposing a thin metal plate having a hexagonal cross section between two thin panels and then compressing the same. The honey-comb board is lightweight and has a great strength. In case a plurality of permanent magnets are disposed in the hexagonal spaces between the thin panels and a magnetic substance is disposed in a book or papers to be placed on the upper panel or the like, the book or papers can be easily fixed on the upper panel.

In the foregoing embodiments, the movable panel and the vertical panel may comprise a round panel, a central portion of which is concave backward. Further, the movable panel and the vertical panel may include a plurality of movable panels and a plurality of vertical panels which are consecutively connected from both sides of the movable panel and the vertical panel. The plurality of movable panels and the plurality of vertical panels may be arranged in the shape of a circular arc or circle around the user.

The desks of the foregoing embodiments may be embodied as a computer-integrated desk, wherein a thin-film type monitor is provided in the upper panel, the horizontal panel, the movable panel, the vertical panel, the expansion panel, the first auxiliary panels, the second auxiliary panels, the third auxiliary panels, or the like and a main body, which includes a main board, a central processing unit (CPU), a memory (RAM), a hard disk, a power supply, etc., is mounted to the first upper panel. In this case, it is preferred that a communication between the main body and the monitor includes a wireless communication. Further, speakers (i.e., a stereophonic sound system) may be embedded in the upper panel or the like. In addition, an image camera for an image communication and a video conference may be mounted to the upper panel or the like.

When the rotational movement and the sliding movement are made by the drive means in an electric-powered manner, the foregoing embodiments may further include a control unit and a manipulation unit. The control unit is configured to control the operation direction, the rotational angle and the moving distance of the drive means under the manipulation of the operation unit. That is, if the user manipulates the manipulation unit, then the drive means is operated based on the predetermined operation direction, rotational angle, moving distance and the like.

The present invention described hereinabove should not be limited to the foregoing embodiments and the accompanying drawings. It will be apparent to those of ordinary skill in the art that various substitutions, alterations and modifications may be made without departing from the scope of the present invention.

What is claimed is:

1. A desk, comprising:

a support leg;

an upper panel coupled to an upper end of the support leg;

a support member extending from the upper panel;

a movable panel having an upper end movable along the support member and a lower end movably placed on the upper panel, the movable panel being movable between a first position inclined with respect to the upper panel and a second position vertical to the upper panel and between the first position and a third position parallel to the upper panel; and a vertical panel rotatably joined to the support member and movably placed on the movable panel at a lower end thereof, the vertical panel being movable along with a movement of the movable panel.

2. The desk of claim 1, wherein the support member further includes a connection member coupled to an upper end of the support member and having a guide groove along the support member, wherein the movable panel includes a moving member coupled to the upper end of the movable panel and moving in the guide groove, and wherein the connection member includes dampers coupled to upper and lower sides of the guide groove.

3. The desk of claim 1, wherein the support member includes:

a first link member having a lower end hinge-coupled to the upper panel;

a second link member having a lower end moving forward and backward on the upper panel and hinge-coupled to the first link member;

a third link member having a lower end hinge-coupled to an upper end of the second link member;

a fourth link member having a lower end hinge-coupled to an upper end of the first link member and an upper end hinge-coupled to an upper end of the third link member;

a connection member coupled to an upper end of the fourth link member and having a guide groove along the fourth link member; and a drive means for moving the lower end of the second link member forward and backward on the upper panel, wherein the movable panel includes a moving member coupled to the upper end of the movable panel and moving in the guide groove.

4. The desk of claim 1, wherein the support member includes:

a first link member having a lower end moving on the upper panel in left and right directions;

a second link member having a lower end moving on the upper panel in left and right directions and hinge-coupled to the first link member;

a third link member having a lower end hinge-coupled to an upper end of the second link member;

a fourth link member having a lower end hinge-coupled to an upper end of the first link member;

a horizontal bar hinge-coupled to upper ends of the third and fourth link members;

connection members vertically extending from both ends of the horizontal bar, each of the connection members having a guide groove vertical to the horizontal bar; and a drive means for moving any one of the lower ends of the first and second link members on the upper panel in a left or right direction, wherein the movable panel comprises a moving member coupled to the upper end of the movable panel and moving in the guide grooves, and wherein the drive means includes:

a drive motor coupled to the upper panel;

a screw shaft coupled to a rotating shaft of the drive motor;

a first nut member threadedly coupled to the screw shaft; and a second nut member sliding along the screw shaft, wherein one of the lower ends of the first and second link members is hinge-coupled to the first nut member and the other of the lower ends of the first and second link members is hinge-coupled to the second nut member.

5. The desk of claim 1, wherein the support member includes:

first and second link members having lower ends hinge-coupled to the upper panel;

a third link member having a lower end hinge-coupled to an upper end of the first link member;

a fourth link member having a lower end hinge-coupled to an upper end of the second link member;

a horizontal bar hinge-coupled to upper ends of the third and fourth link members;

connection members vertically extending from both ends of the horizontal bar, each of the connection members having a guide groove vertical to the horizontal bar; and a drive means for moving the horizontal bar, wherein the movable panel comprises a moving member coupled to the upper end of the movable panel and moving within the guide grooves.

6. The desk of claim 1, wherein the support member includes:

first and second guide members inserted to the support leg and sliding upward and downward;

a horizontal bar disposed between the guide members;

connection members vertically extending from both ends of the horizontal bar, each of the connection members having a guide groove vertical to the horizontal bar; and a drive means for moving the horizontal bar, wherein the movable panel includes a moving member coupled to the upper end of the movable panel and moving within the guide grooves.

7. The desk of claim 1, further comprising a second support member having one end hinge-coupled to the upper panel, the second support member being hinge-coupled to a backside of the movable panel.

8. The desk of claim 1, wherein the upper panel includes:

a first upper panel coupled to the support leg;

a support arm having one end rotatably coupled to the support leg; and a second upper panel having a second upper panel frame rotatably coupled to the opposite end of the support arm, the second upper panel sliding with respect to the second upper panel frame.

9. The desk of claim 1, wherein the movable panel includes:

a movable panel frame coupled to both sides of the movable panel and rotatably supporting the movable panel;

an extendable and retractable first arm rotatably coupled to a lower end of the movable panel frame and spacing apart the lower end of the movable panel from the upper panel;

a first moving member coupled to an end of the first arm;

a second arm coupled to an upper end of the movable panel frame;

a second moving member coupled to an end of the second arm; and a stopper foldably coupled to the lower end of the movable panel, and wherein the vertical panel includes:

a vertical panel frame coupled to both sides of the vertical panel;

an extendable and retractable arm coupled to a lower end of the vertical panel frame and spacing apart the lower end of the vertical panel from the movable panel;

a moving member coupled to an end of the arm; and a stopper coupled to the lower end of the vertical panel.

10. The desk of claim 1, further comprising a retractable link arm having one end rotatably coupled to the support member and an opposite end rotatably coupled to the vertical panel.

11. The desk of claim 1, further comprising a drive means for moving the lower end of the movable panel along the upper panel.

12. The desk of claim 8, further comprising a drive means driving the support leg, the second upper panel, the movable panel and the vertical panel, respectively;

a manipulation unit manipulating the drive means; and a control unit configured to control an operation direction, a rotation angle and a moving distance of the drive means by the manipulation of the manipulation unit.

13. The desk of claim 1, further comprising a drive means for moving the upper end of the movable panel along the support member.

14. The desk of claim 1, wherein the movable panel further includes a first auxiliary panel foldably coupled to a side of the movable panel, and wherein the vertical panel further includes a second auxiliary panel foldably coupled to a side of the vertical panel.

15. The desk of claim 1, further comprising an expansion panel coupled to an upper side of the vertical panel, wherein the expansion panel further includes third auxiliary panel foldably coupled to left and right sides of the expansion panel.

16. The desk of claim 1, wherein the movable panel includes a fixed panel and a rotational panel rotatably coupled to an end of the fixed panel.

17. The desk of claim 1, further comprising a flat panel display disposed in the upper panel, the movable panel, or the vertical panel;

an image camera; and a main body of a computer electrically connected to the flat panel display.

18. The desk of claim 1, further comprising a second drive means for vertically lifting and lowering the desk.

19. The desk of claim 1, wherein the movable panel and the vertical panel comprise a round panel with a central portion concave backwardly.

20. The desk of claim 1, wherein the movable panel comprises a plurality of movable panels consecutively connected from both sides of the movable panel, the plurality of movable panels being arranged in a shape of a circular arc or a circle, and wherein the vertical panel comprises a plurality of vertical panels consecutively connected from both sides of the vertical panel, the plurality of vertical panels being arranged in a shape of a circular arc or a circle.

* * * * *